US008303057B2

(12) United States Patent
Kuramata et al.

(10) Patent No.: US 8,303,057 B2
(45) Date of Patent: Nov. 6, 2012

(54) OPENING AND CLOSING SUPPORT MECHANISM AND APPARATUS USING THE SAME

(75) Inventors: Takashi Kuramata, Saitama (JP); Yousuke Hasegawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 960 days.

(21) Appl. No.: 12/253,617

(22) Filed: Oct. 17, 2008

(65) Prior Publication Data

US 2009/0113805 A1 May 7, 2009

(30) Foreign Application Priority Data

Nov. 5, 2007 (JP) ..... P2007-287186

(51) Int. Cl.
*A47B 88/00* (2006.01)
*E05F 3/00* (2006.01)
*E05F 1/08* (2006.01)

(52) U.S. Cl. ..... 312/328; 16/67; 16/78

(58) Field of Classification Search ..... 312/325–329, 312/248, 271; 49/147, 381; 16/78, 67; 399/107, 399/110, 124; 347/108; 296/57.1, 61, 62; 68/196; 134/200; 188/300; 220/831, 832
See application file for complete search history.

(56) References Cited

U.S. PATENT DOCUMENTS 5,018,687 A * 5/1991 Kupfernagel et al. ..... 244/129.5
6,877,830 B2 * 4/2005 Salice ..... 312/327
6,993,268 B2 * 1/2006 Otaka ..... 399/124
7,844,199 B2 * 11/2010 Suzuki et al. ..... 399/121
2002/0127028 A1 * 9/2002 Amano ..... 399/88
2007/0215594 A1 * 9/2007 Hashimoto et al. ..... 219/400
2008/0025749 A1 * 1/2008 Igarashi ..... 399/92

FOREIGN PATENT DOCUMENTS

JP 2001-142271 5/2001
JP 2004-045585 2/2004
JP 2004-177424 6/2004
JP 2006-284805 10/2006

* cited by examiner

*Primary Examiner* — David Dunn
*Assistant Examiner* — Ryan A Doyle
(74) *Attorney, Agent, or Firm* — Morgan, Lewis & Bockius LLP

(57) ABSTRACT

An opening and closing support mechanism includes: a main body; an opening and closing member; and a support member includes: a first joint support portion that curves to deform when the opening and closing member is closed, and extends straight when the opening and closing member is opened; and a projection portion that projects to an opposite side of a curving side of the first joint support portion at a side of either one end portion or the other end portion of first joint support portion when the opening and closing member is closed, and is elastically deformed in a direction of approaching the first joint support portion while pressed against a portion of the main body or opening and closing member when the opening and closing member is opened, and the support member being fitted between the main body and the opening and closing member.

10 Claims, 25 Drawing Sheets

OPENING AND CLOSING SUPPORT MECHANISM AND APPARATUS USING THE SAME

CROSS-REFERENCE TO RELATED APPLICATIONS

This application is based on and claims priority under 35 U.S.C. 119 from Japanese Patent Application No. 2007-287186 filed Nov. 5, 2007.

BACKGROUND

1. Technical Field

The present invention relates to an opening and closing support mechanism and an apparatus using the same.

2. Related Art

As an opening and closing mechanism to be used for an opening and closing member which opens and closes around a support shaft as a pivot with respect to main bodies of various apparatuses, the following applied to an image forming apparatus such as a printer, a copying machine, or a facsimile, etc., are known.

SUMMARY

According to an aspect of the present invention, an opening and closing support mechanism includes: a main body; an opening and closing member that opens and closes around a support shaft as a pivot with respect to the main body; and a support member includes: a first joint support portion that has one end portion attached to the main body rotatably and the other end portion attached to the opening and closing member rotatably, the first joint support portion curving to deform when the opening and closing member is closed, and extending straight when the opening and closing member is opened; and a projection portion that projects to an opposite side of a curving side of the first joint support portion at a side of either one end portion or the other end portion of the first joint support portion when the opening and closing member is closed, and is elastically deformed in a direction of approaching the first joint support portion while pressed against a portion of the main body or opening and closing member when the opening and closing member is opened, and the support member being fitted between the main body and the opening and closing member.

BRIEF DESCRIPTION OF THE DRAWINGS

Exemplary embodiment of the present invention will be described in detail based on the following figures, wherein.

DETAILED DESCRIPTION

Figure 1:
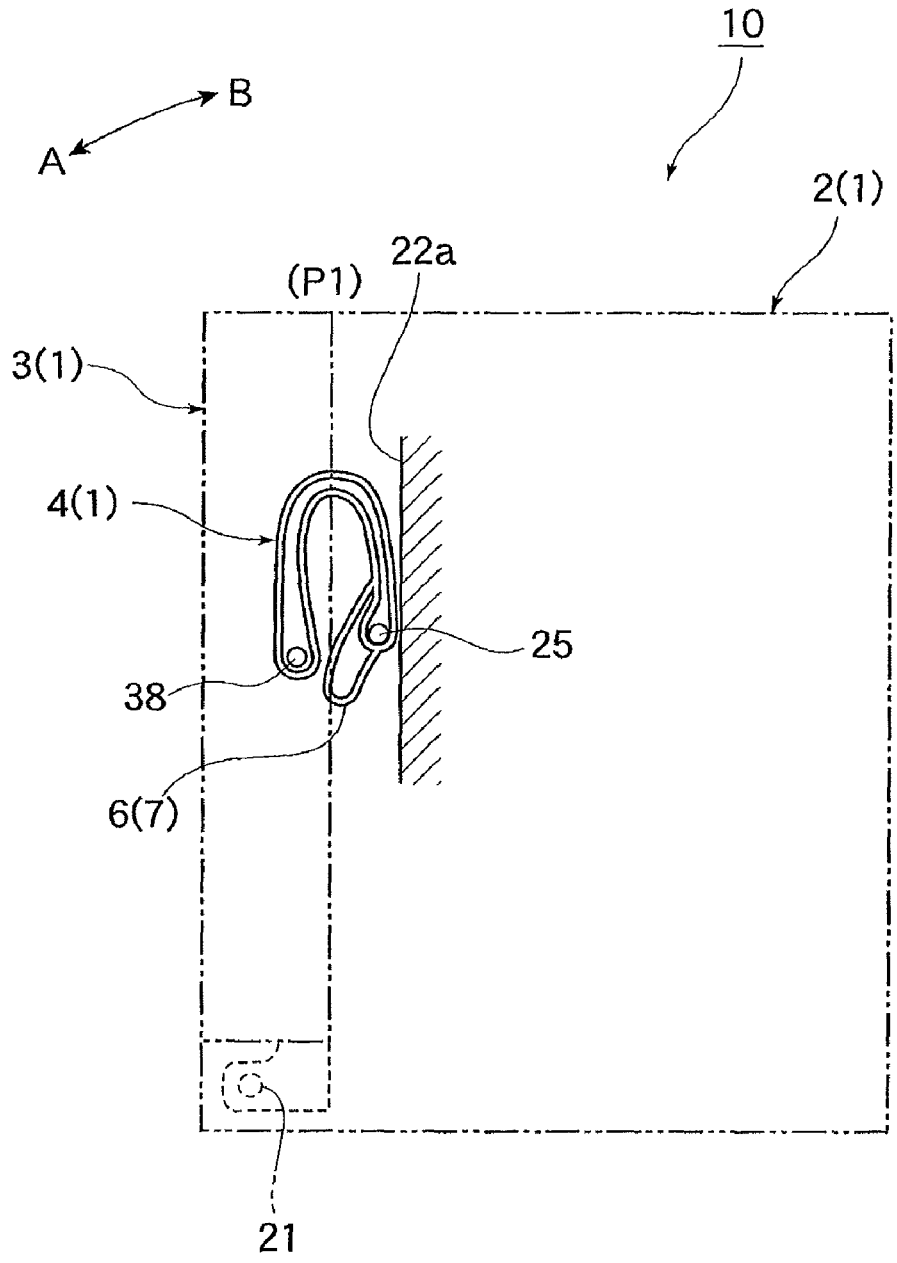
FIG. 1 is an explanatory view showing a main portion (in a state when an opening and closing unit is closed) of an opening and closing support mechanism of the embodiment and an image forming apparatus using the opening and closing support mechanism.
Figure 2:
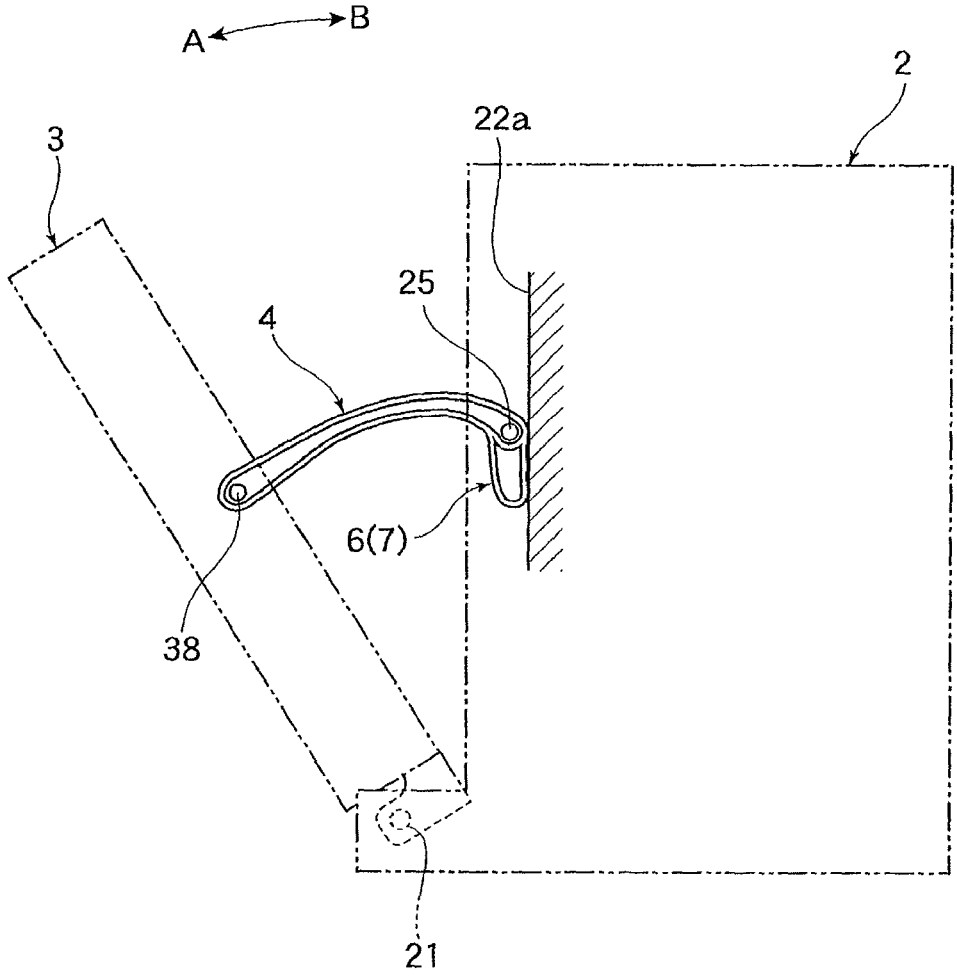
FIG. 2 is an explanatory view showing a state in the middle of starting opening (or closing) of the opening and closing unit in FIG. 1.
Figure 3:
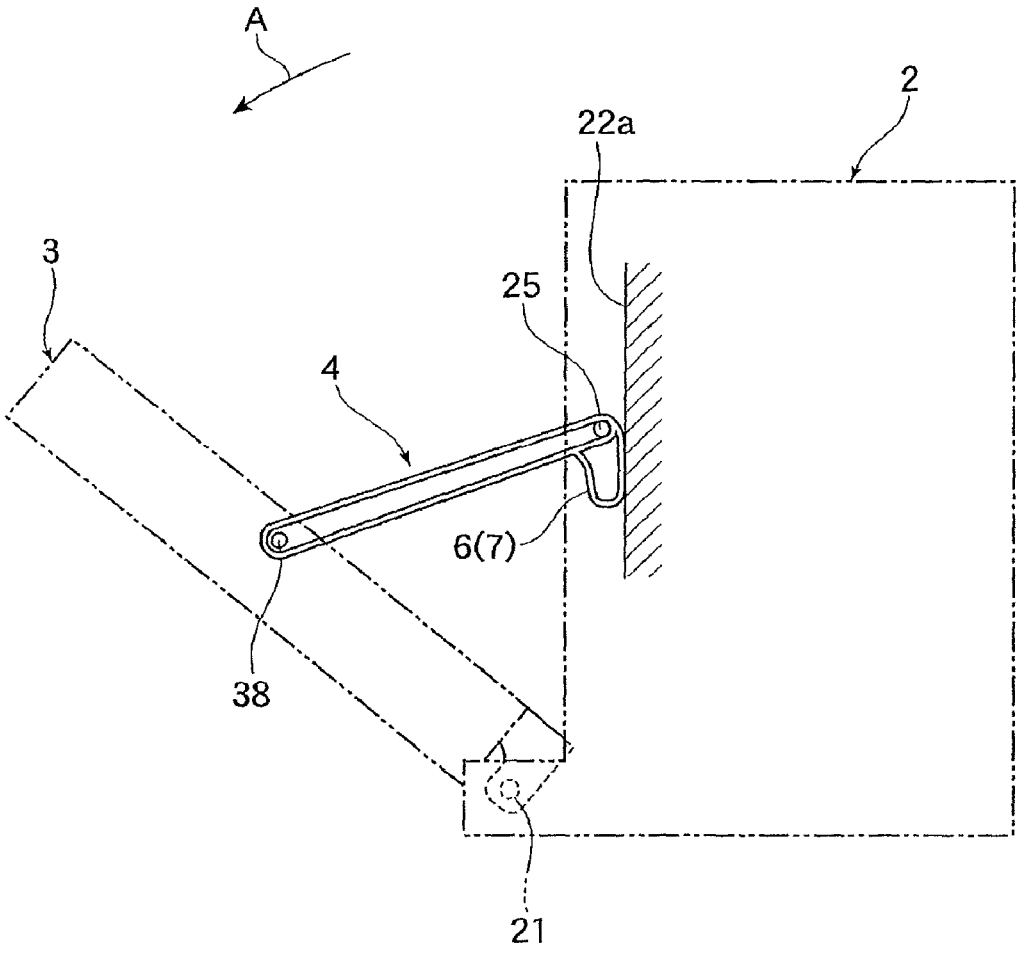
FIG. 3 is an explanatory view showing a state where the opening and closing unit is completely opened in FIG. 1.

FIG. 1 to FIG. 3 are explanatory views showing a main portion of an opening and closing support mechanism of an embodiment of the invention and an image forming apparatus using the opening and closing support mechanism.

Figure 4:
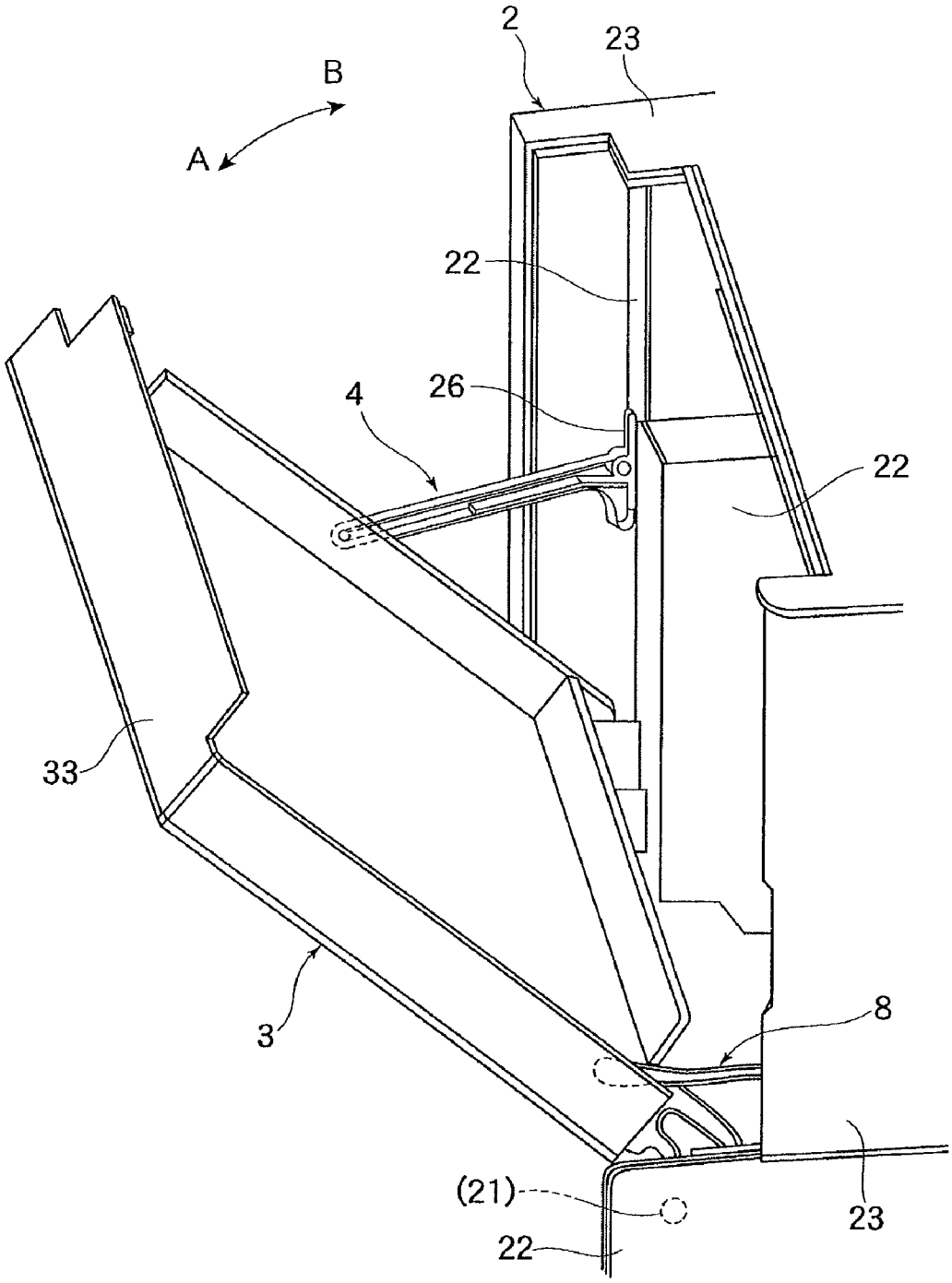
FIG. 4 is a perspective view schematically showing the state where the opening and closing unit is opened of FIG. 3.

In FIG. 1 to FIG. 3, the reference numeral 2 denotes an apparatus main body of an image forming apparatus 10, a reference numeral 3 denotes an opening and closing unit which opens and closes around a support shaft 21 as a pivot with respect to the apparatus main body 2, and a reference numeral 4 denotes a support member in an opening and closing support mechanism 1 fitted between the apparatus main body 2 and the opening and closing unit 3. FIG. 1 shows a state where the opening and closing unit 3 is closed, and FIG. 2 shows a state during starting opening (or closing) of the opening and closing unit 3, and FIG. 3 shows a state where the opening and closing unit 3 is opened. Further, FIG. 4 is a perspective view showing a state where the opening and closing unit 3 is opened, and FIG. 5 is a perspective view showing a state of the support member 4 when the opening and closing unit 3 is opened.

The apparatus main body 2 in the image forming apparatus 10 is constructed by a main body frame 22 and an outer cover 23. To the main body frame 22, an image-forming device not shown adopting any recording method of the known electrophotographic method, electrostatic recording method, ink-jet recording method, and thermosensitive recording method, etc., is fitted. In this apparatus main body 2, a sheet (recording medium which images can be formed on and can be conveyed) is conveyed from a paper feed section not shown to the image-forming device, and in the image-forming device, images based on predetermined input image information are formed on one side of the sheet according to the predetermined recording method.

Figure 6:
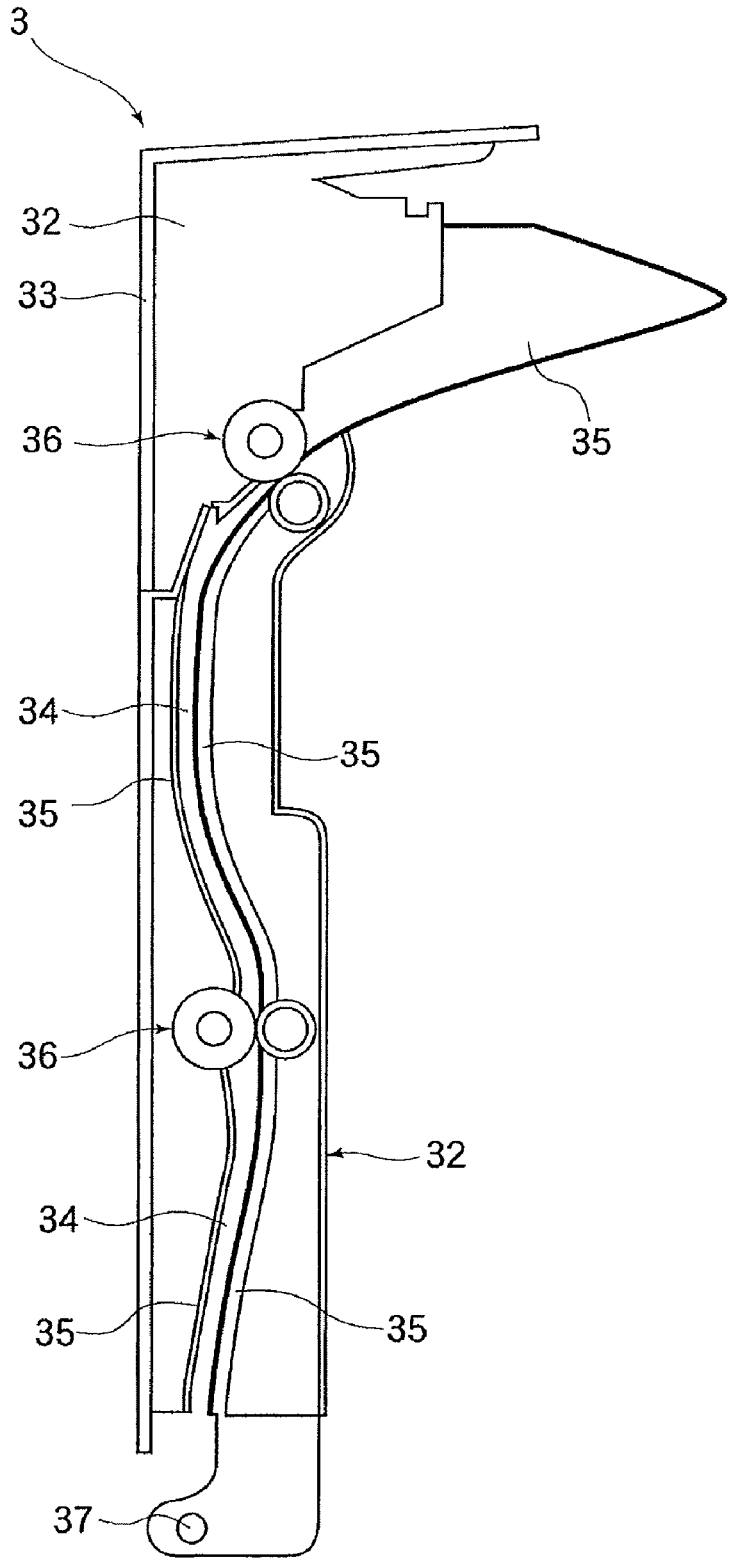
FIG. 6 is an explanatory view showing a construction example of the opening and closing unit.

The opening and closing unit 3 is constructed as, for example, in the image-forming device of the apparatus main body 2, a sheet conveyance unit which conveys again (refeeds) a sheet one side on which images were formed to the image-forming device. Specifically, the base portion of the opening and closing unit 3 is formed by a support frame 32 and an outer cover 33 as shown in FIG. 6, and the support frame 32 is provided with a plurality of conveyance guide members 35 for forming a sheet conveyance path 34 and a plurality of conveyance rolls 36 for feeding the sheet to a predetermined position of the conveyance path 34. The reference numeral 37 in FIG. 6 denotes a shaft hole for inserting a support shaft 21. The support frame, the conveyance guide members, and the conveyance rolls in the opening and closing unit 3 are not shown in FIG. 4. The opening and closing unit 3 is attached by inserting the shaft hole 31 onto the support shaft 21 provided on the apparatus main body 2, and opens and closes by being moved in the directions of the arrows A and B around the support shaft 21 as a pivot.

Figure 5:
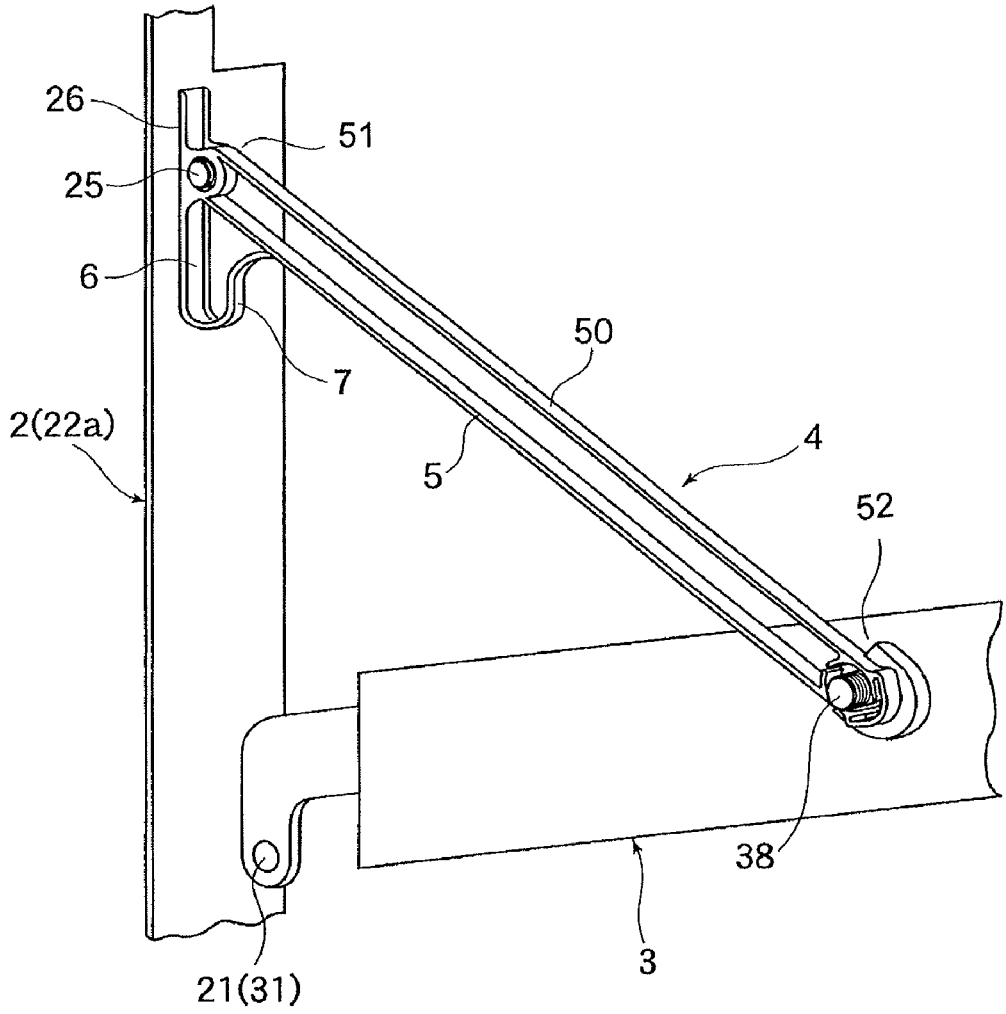
FIG. 5 is a perspective view showing an attached state of the support member.
Figure 7:
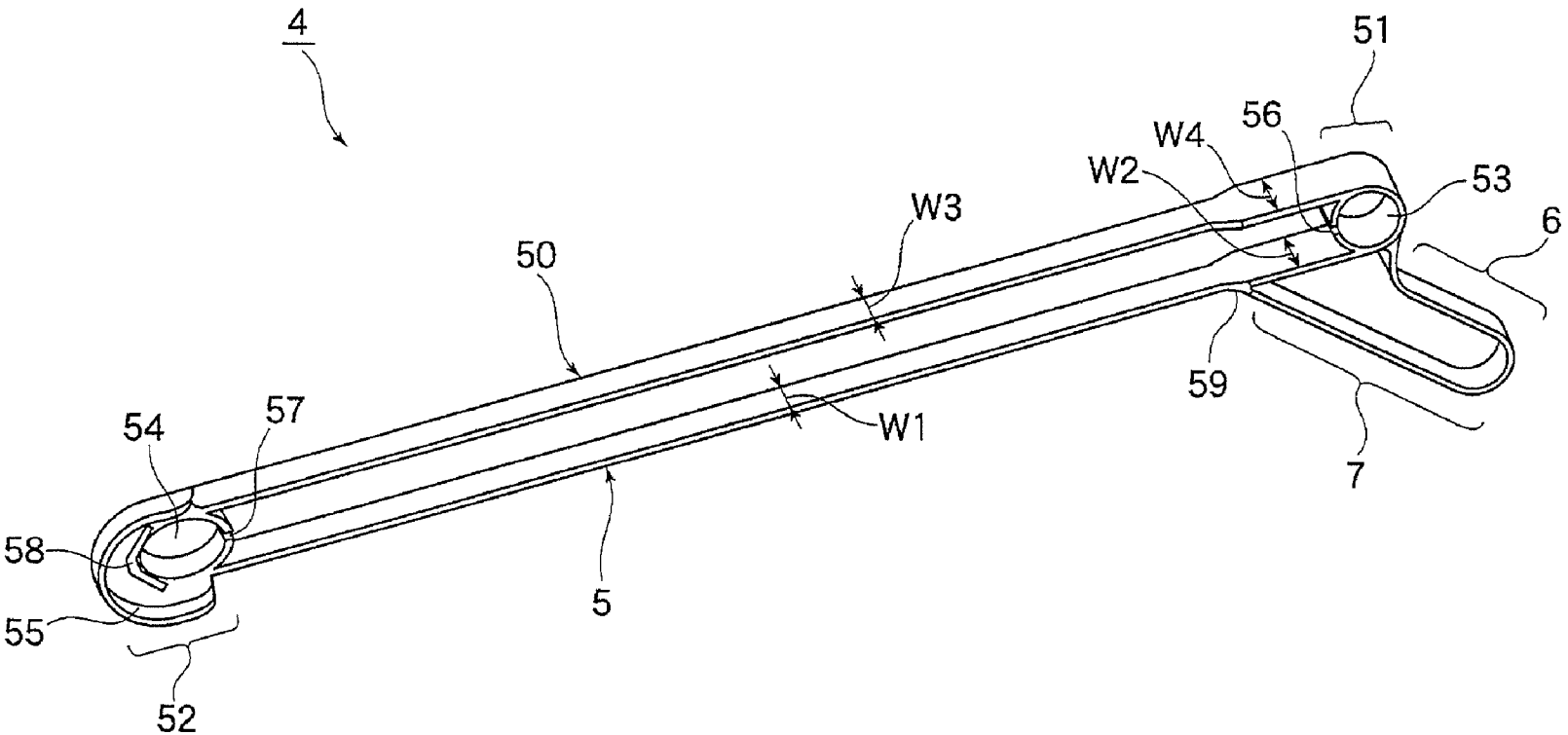
FIG. 7 is a perspective view showing a support member.
Figure 8:
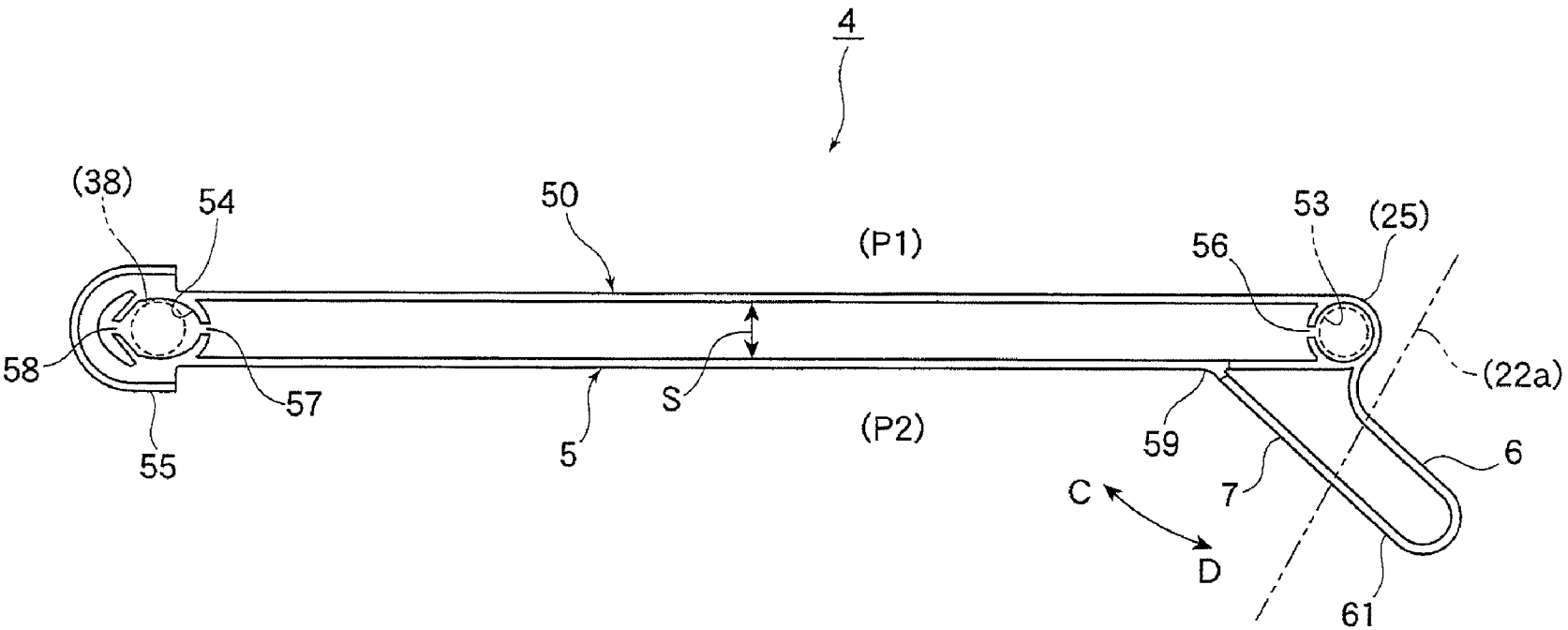
FIG. 8 is a front view showing the support member of FIG. 7.

The support member 4 in the opening and closing support mechanism 1 has at least a joint support portion 5 and a projection portion 6 as shown in FIG. 5, FIG. 7 and FIG. 8, etc.

The joint support portion 5 has a band-like shape as a whole, and one side thereof includes a main body side end portion 51 attached rotatably to the apparatus main body 2, and the other side includes an opening and closing unit side end portion 52 attached rotatably to the opening and closing unit 3. The joint support portion 5 is curved and deformed into a substantially inverted-U shape as shown in FIG. 1 when the opening and closing unit 3 is closed, and extends straight as shown in FIG. 3 when the opening and closing unit 3 is opened.

In this embodiment, the joint support portion 5 is constructed so that one end portion 51 is in a cylindrical form as shown in FIG. 7, etc., having a main body side shaft insertion hole 53 to be inserted onto an attaching shaft 25 (FIG. 9) provided on the apparatus main body 2 side, and the other end portion 52 is in a cylindrical form having an opening and closing unit shaft insertion hole 54 to be inserted onto an attaching shaft 38 (FIG. 10) provided on the opening and closing unit 3 side.

The joint support portion 5 is formed in a state where it is connected to a portion of the side at which the projection portion 6 is formed of the main body side end portion 51 and the opening and closing unit side end portion 52 having cylindrical forms (hereinafter, these end portions may be referred to as "both end portions 51 and 51" or "end portions 51 and 52" simply). Further, parallel to the joint support portion 5, a second joint support portion 50 having a band-like shape is provided while leaving a predetermined space S (FIG. 8) from the joint support portion 5 in a state where the portion at the side at which the projection portion 6 is not formed of the end portions 51 and 52 in the cylindrical forms is connected. The joint support portion 5 and the second joint support portion 50 in this example face each other substantially parallel to each other across both end portions 51 and 52.

Figure 9:
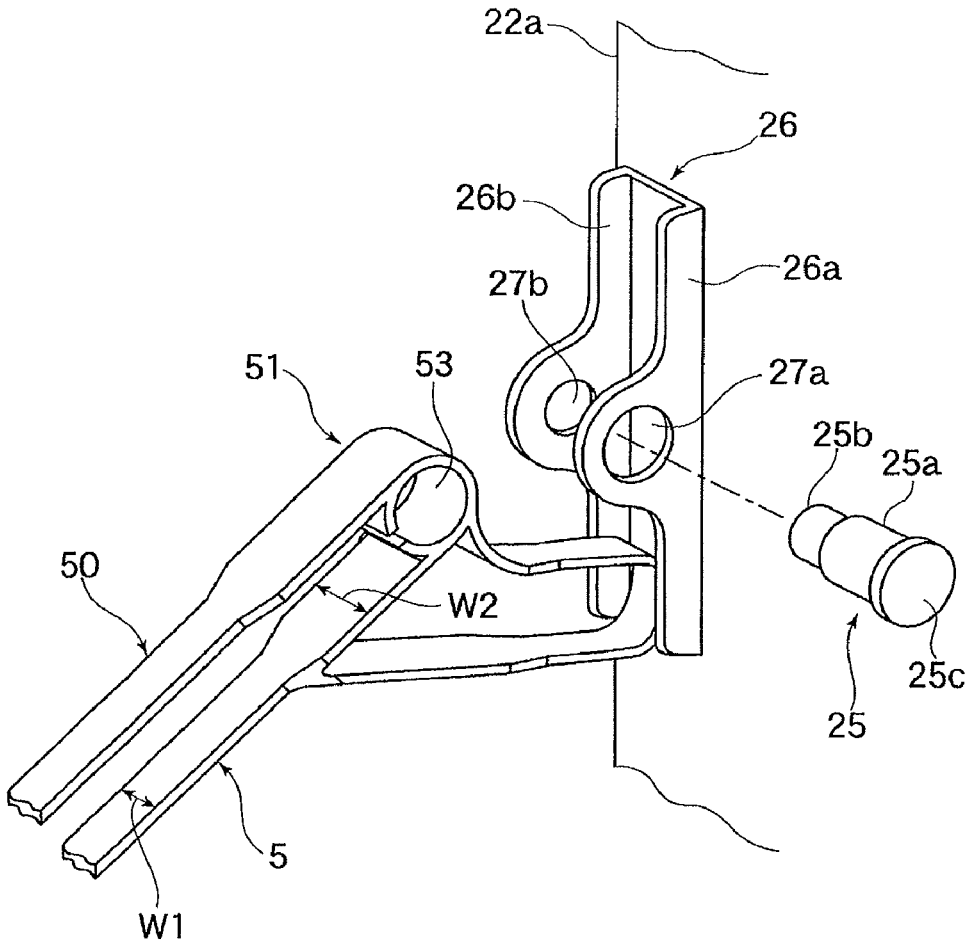
FIG. 9 is an exploded perspective view showing an attaching construction of the end portion on the side at which a projection portion is formed of the support member.

Herein, the joint support portion 5 is attached rotatably by inserting an inserting support shaft 25 through a shaft insertion hole 27 of a shaft attaching member 26 and a shaft insertion hole 53 of the main body side end portion 51 after the main body side end portion 51 is fitted into the shaft attaching member (bracket) 26 fixed to a wall surface 22*a* of the support frame of the apparatus main body 2 as shown in FIG. 5 and FIG. 9, etc. The shaft attaching member 26 is formed by forming the shaft insertion hole 27 in a pair of side wall portions 26*a* and 26*b* which are bent so as to rise from both end portions of a plate-like member and face each other. As the support shaft 25, a support shaft formed by a large-diameter shaft portion 25*a*, a small-diameter shaft portion 25*b* with a diameter relatively smaller than that of the large-diameter shaft portion 25*a*, and a stopper portion top portion 25*c* formed on the side opposite to the small-diameter shaft portion 25*b* of the large-diameter shaft portion 25*a* are used. To use this support shaft 25, in the side wall portion 26*a* of the shaft attaching member, a shaft insertion hole 27*a* with a hole diameter which allows the large-diameter shaft portion 25*a* to be inserted through is formed, and in the side wall portion 26*b*, a shaft insertion hole 27*b* having a small hole diameter which allows the small-diameter shaft portion 25*b* to be inserted through is formed.

Figure 10:
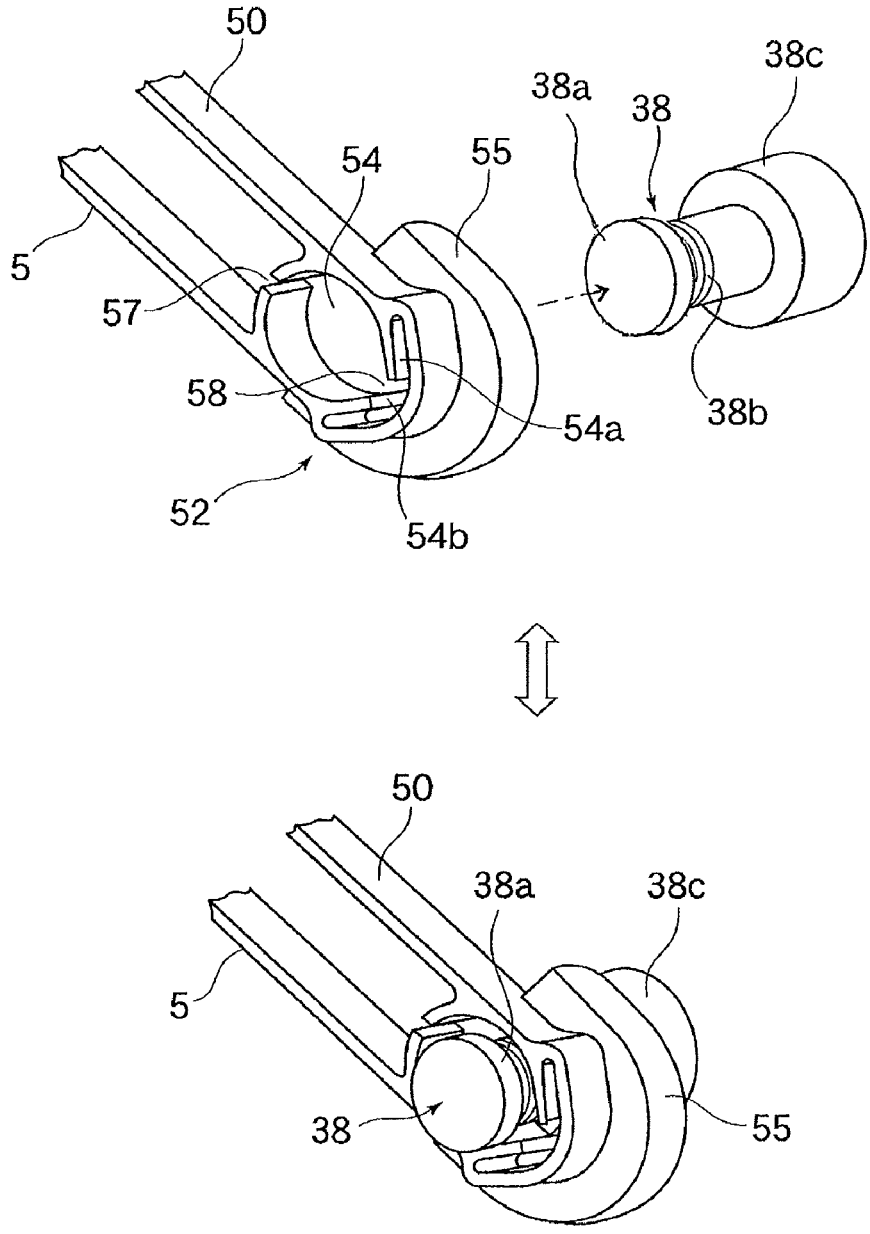
FIG. 10 is an exploded view and a combined perspective view showing an attaching construction of the end portion on the side opposite to the side at which the projection portion is formed of the support member of FIG. 7.

The joint support portion 5 is attached rotatably by inserting the opening and closing unit side end portion 52 into the support shaft 38 provided on (the support frame 32 of) the opening and closing unit 3 through the opening and closing unit side shaft insertion hole 54 as shown in FIG. 5 and FIG. 10, etc. On the tip end portion of the support shaft 38, a large-diameter end portion 38*a* having a diameter larger than that of the shaft 38 is formed, and on the inner side of the large-diameter end portion 38*a*, a groove 38*b* to be used for fitting an E ring and a wire clip such as a KL clip is formed. On the opening and closing unit side end portion 52, for preventing attaching of the shaft insertion hole 54 in an inverted posture, a flange 55 to be fitted into a columnar seat portion 38*c* with a diameter larger than that of the shaft 38 formed on the base side of the support shaft 38 is formed.

Further, on the joint support portion 5, as shown in FIG. 7 and FIG. 8, etc., gap portions 56 and 57 spaced so as to notch cylindrical portions (inner peripheries of the holes) facing each other of the main body side shaft insertion hole 53 and the opening and closing unit side insertion hole 54 (hereinafter, these insertion holes may be referred to as "shaft insertion holes" simply) by predetermined amounts, respectively, are formed. The gap portions 56 and 57 in this example are formed at portions of the end portions 52 and 51 positioned between the joint support portion 5 and the second joint support portion 50, and these gap portions 56 and 57 link the shaft insertion holes 53 and 54 and the space positioned between the joint support portion 5 and the second joint support portion 50. Between these gap portions, the gap portion 56 formed at the main body side end portion 51 is formed at a portion of the main body side end portion 51 positioned at the opposite side of the projection portion 6 via the joint support portion 5.

On the other hand, the projection portion 6 of the support member 4 projects toward the opposite side (P2) of the side (P1) which curves when the opening and closing unit 3 closes at the position of the main body side end portion 51 of the joint support portion 5 as shown in FIG. 7 and FIG. 8, etc., and is elastically deformed in the direction C of approaching the joint support portion 5 while pressed against a portion of (the wall surface 22*a* of the support frame) the apparatus main body 2 (the support frame 22 of) when the opening and closing unit 3 is opened.

Figure 13:
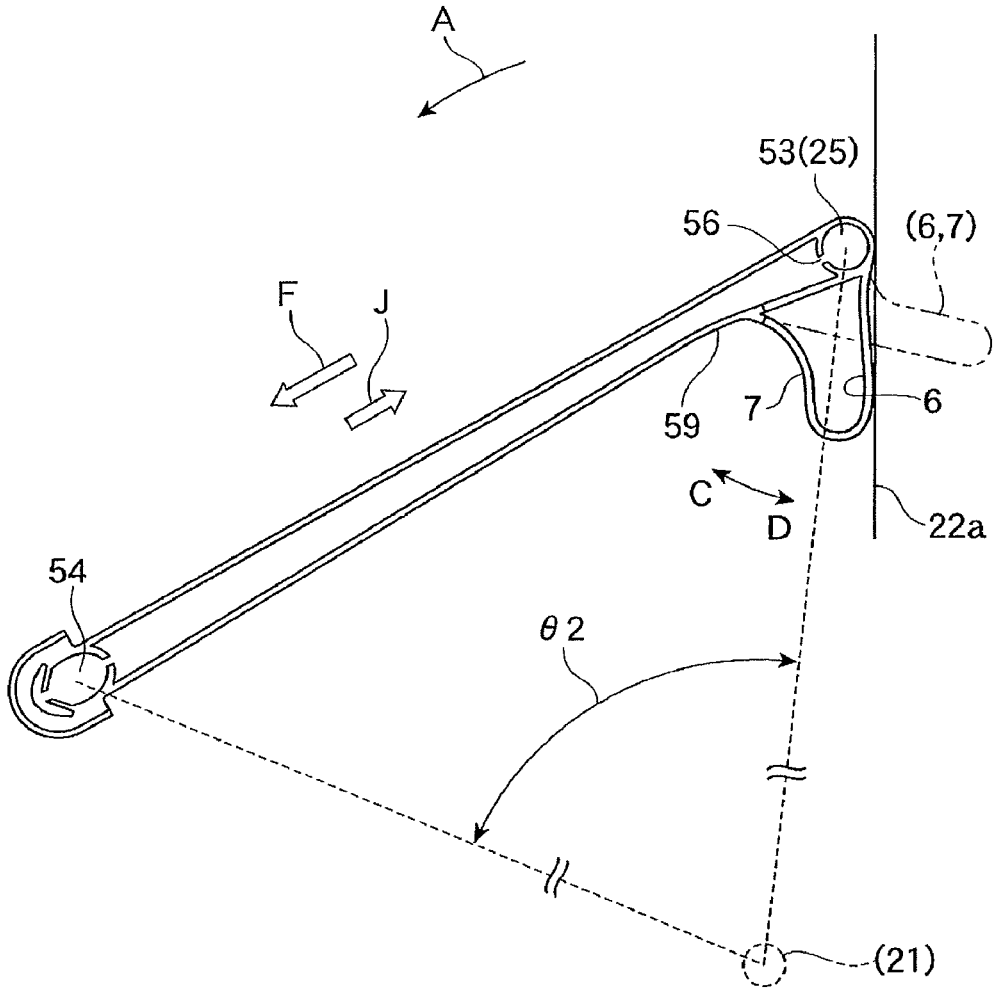
FIG. 13 is an explanatory view showing a state of the support member of FIG. 7 when the opening and closing unit is completely opened.

The alternate long and short double-dashed line in FIG. 8 indicates the wall surface 22*a* of the support frame of the apparatus main body 2 against which the projection portion 6 is pressed when the opening and closing unit 3 is completely opened (see FIG. 13). In this FIG. 8, the portion of the projection portion 6 projecting on the right side of the alternate long and short double-dashed line in FIG. 8 shows a state when assuming the support frame 22*a* is absent when the opening and closing unit 3 is opened, and in actuality, this portion is elastically deformed in the direction C of approaching the joint support portion 5 in the process of opening the opening and closing unit 3, and finally comes to the left side of the alternate long and short double-dashed line. The amount of the projection portion 6 projecting from the support frame portion 22*a* indicated by the alternate long and short double-dashed line is one of the factors in determining the elastic deformation amount of the projection portion 6 when the opening and closing unit 3 is opened, and inevitably, determines the amount of impact to be absorbed of the support member 4.

In this embodiment, the projection portion 6 is formed so that it projects from the main body side end portion 51 of the joint support portion 5 in a warping state toward the side apart from the opening and closing unit side end portion 52 and then bends to the side of the presence of the opening and closing unit side end portion 52, and is finally connected to a portion of the joint support portion 5. The portion of this projection portion 6 between the bended portion 61 and the position 59 connected to the joint support portion 5 functions as a connecting portion 7 to the joint support portion 5. The projection portion 6 and the connecting portion 7 in this example are formed as one curved annular shape as a whole.

In the joint support portion 5, as shown in FIG. 7, etc., the width W1 of a portion (curved housing portion) from the opening and closing unit side end portion 52 opposite to the main body side end portion 51 at which the projection portion 6 is formed to the position 59 to which the connecting portion 7 is connected is set to a width narrower than the width W2 of the other portion (W1<W2). In the second joint support portion 50, the width W3 corresponding to the curved housing portion of the joint support portion 5 is also set to a width narrower than the width W4 of the other portion (W3<W4). The widths W1 and W3 corresponding to the curved housing portion are set to widths substantially equal to each other (W1≈W3), and the widths W2 and W4 of the other portions are set to widths substantially equal to each other (W2≈W4).

Further, on the opening and closing unit side end portion 52 in which the opening and closing unit side shaft insertion hole 54 of the joint support portion 5 is formed, a gap portion 58 spaced so as to notch a portion of the circumference of the shaft insertion hole 54 at a portion facing the gap portion 57 is formed. In other words, on the joint support portion 5 in which the opening and closing unit side shaft insertion hole 54 is formed, the gap portion 58 shaped so as to notch a portion of the end surface of the hollow cylindrical shape having an inner diameter corresponding to the opening and closing unit side shaft insertion hole 54 is formed, and the shaft insertion hole end portions 54*a* and 54*b* facing each other across the gap portion 58 on the end surface of the hollow cylindrical shape are formed into plate-like shapes elastically deformable. Accordingly, the opening and closing unit side shaft insertion hole 54 is easily elastically deformed when the joint support portion 5 is attached to the support shaft 39 and can absorb impact applied to the shaft insertion hole 54 when the opening and closing unit 3 is opened, and eventually, a function of absorbing impact which influences the opening and closing unit 3 is obtained.

The support member 4 described above is manufactured according to an injection molding method by using a synthetic resin such as polyethylene terephthalate (PET). In the support member 4, the thicknesses of the joint support portion 5 and the second joint support portion 50 were set to about 1 millimeter, the width W1 (W3) was set to about 6 millimeters, the width W2 (W4) was set to about 10 millimeters, and the thicknesses of the projection portion 6 and the connecting portion 7 were set to about 1 millimeter, and the widths (same as W2 and W4) were set to about 10 millimeters. The lengths of the joint support portion 5 and the second joint support portion 50 are determined according to the settings of the angle of the opening and closing unit 3 when it is opened and the attached position of the joint support portion 5, etc. The projection portion amounts, projection portion directions (including angles), and entire lengths, etc., of the projection portion 6 and the connecting portions 7 determine the time of starting the elastic deformation of the entirety of these and an external force required for the elastic deformation, and these are properly determined according to the amounts required for absorbing impact of the support member 4.

Next, operations of the opening and closing support mechanism 1 to which the support member 4 is fitted will be described.

Figure 11:
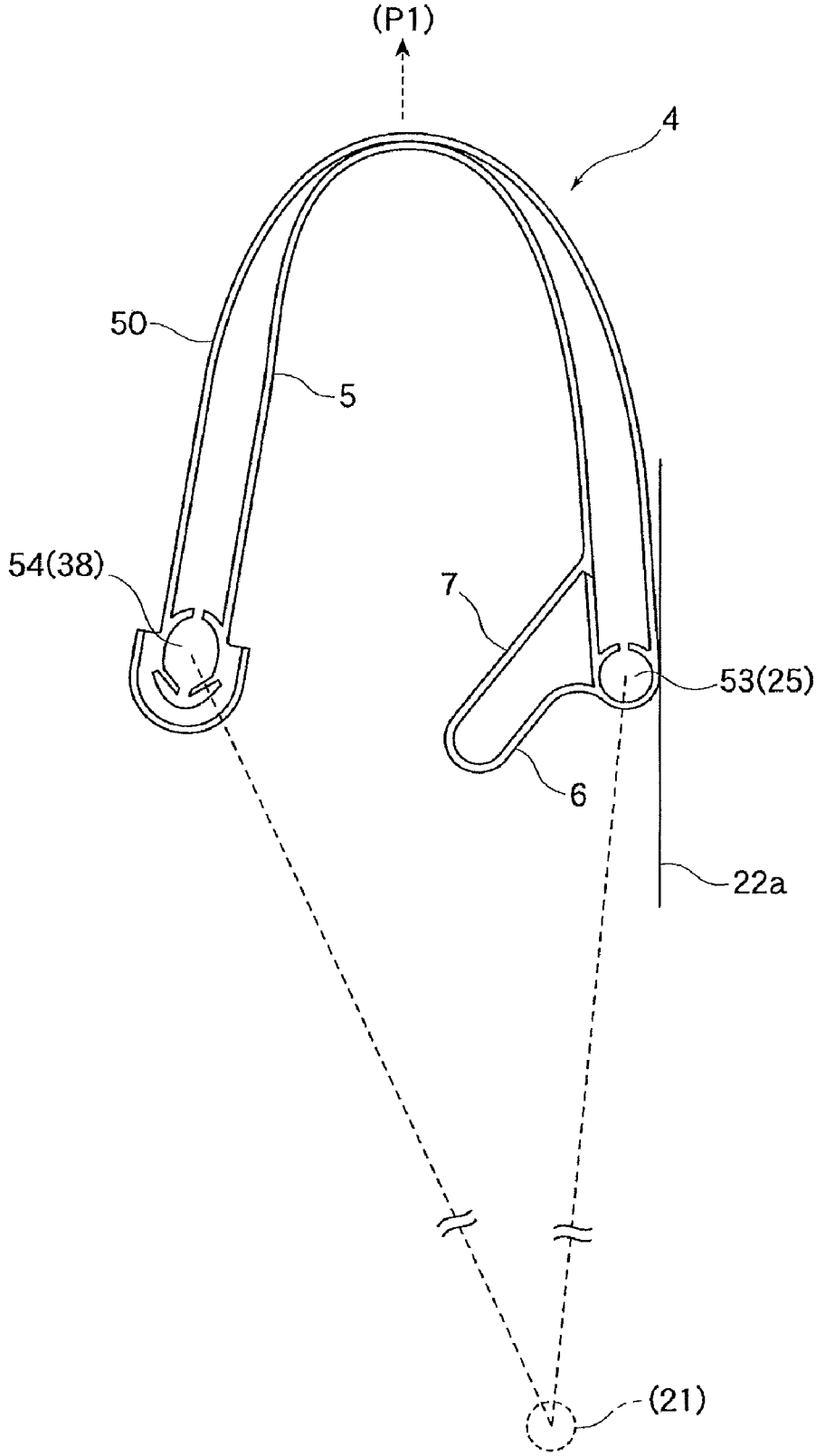
FIG. 11 is an explanatory view showing a state of the support member of FIG. 7 when the opening and closing unit is closed.

First, when the opening and closing unit 3 as an opening and closing object is closed, as shown in FIG. 1 and FIG. 11, both end portions 51 and 52 of the joint support portion 5 (and the second joint support portion 50) of the support member 4 are restricted by the positional relationship between respective attaching shafts 25 and 38 to which the end portions are attached and are positioned close to each other, so that in a state where both end portions 51 and 52 are supported rotatably by the attaching shafts 25 and 38, the joint support portion is curved and deformed upward (P1) substantially at the central portion of the joint support portion 5 (and the second joint support portion 50). At this time, the joint support portion 5 and the second joint support portion 50 are in a state where a portion of the outside surface of the joint support portion 5 positioned on the inner side when it curves is in contact with a portion of the inside surface of the second joint support portion 50. The portions formed with relatively narrow widths W1 and W3 of the joint support portion 5 and the second joint support portion 50 are easily curved and deformed. Incidentally, the projection portion 6 in this support member 4 is apart from the wall surface 22*a* of the support frame 22 of the apparatus main body 2.

The curved and deformed portions such as the joint support portion 5, etc., are suitably accommodated in an empty space present between the opening and closing unit 3 and the apparatus main body 2 (for example, the side portion). At this time, the reason for upward curving and deformation of the joint support portion 5, etc., is that, as above-described with reference to FIG. 8, when assuming that the projection portion 6 does not come into contact with the wall surface 22*a* due to the angle formed between the joint support portion 5 and the wall surface 22 (alternate long and short double-dashed line) of the support frame in the state where the support member 4 extends straight, the angle between the joint support portion 5 and the projection portion 6 is set so as to be great. Accordingly, when the projection portion 6 comes into contact with the wall surface 22*a*, an upward (P1) force is applied to the joint support portion 5.

Figure 12:
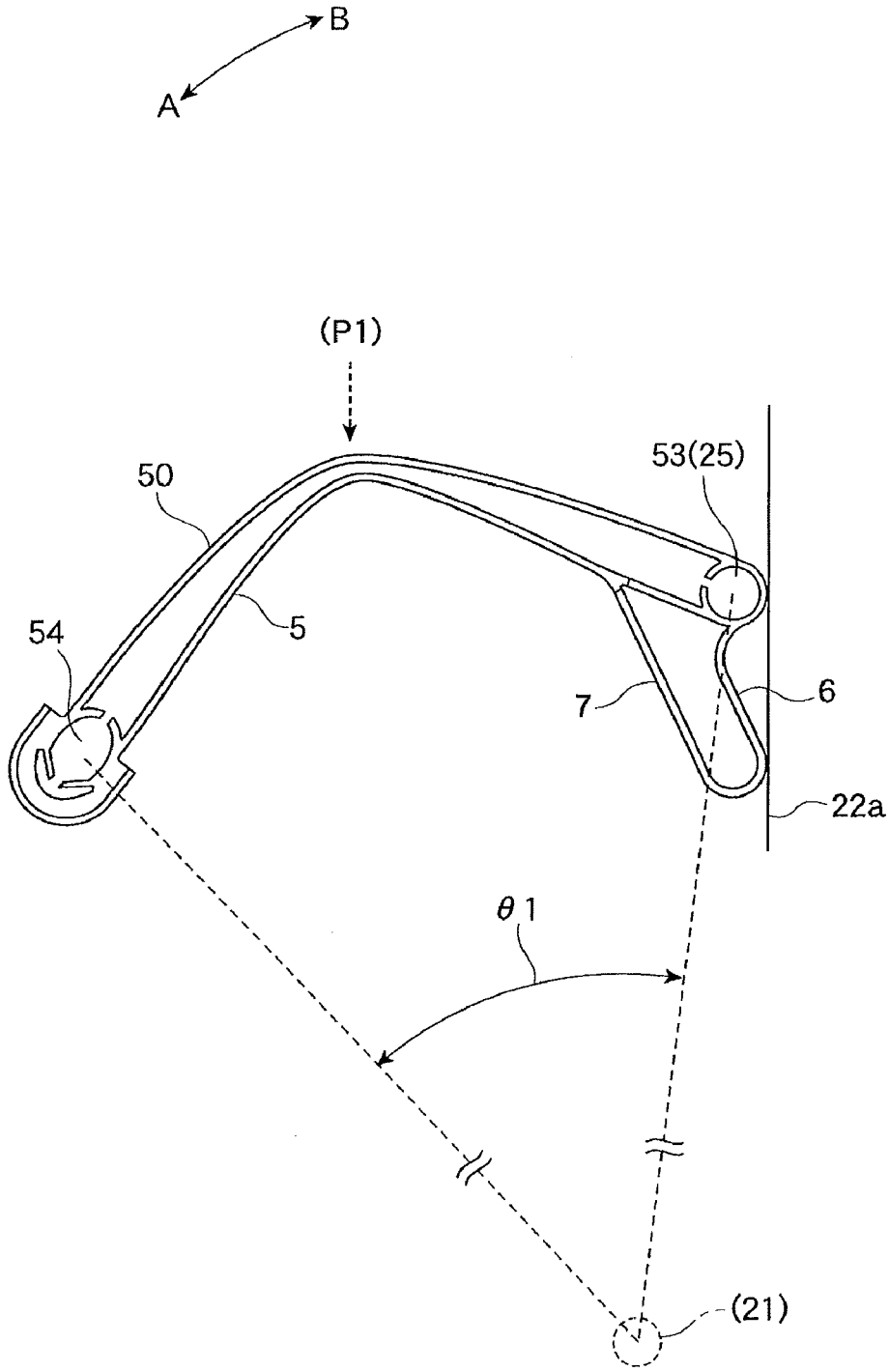
FIG. 12 is an explanatory view showing a state of the support member of FIG. 7 in the middle of starting opening of the opening and closing unit.

Subsequently, when the opening and closing unit 3 is moved and opened in the arrow A direction, as shown in FIG. 2 and FIG. 12, according to the opening angle θ (opening and closing angle) of the opening and closing unit 3 (angle between the attaching shaft 25 on the apparatus main body 2 side and the attaching shaft 38 on the opening and closing unit 3 side in the support shaft 21), the attaching shaft 38 on the opening and closing unit 3 side moves so as to move apart diagonally downward from the attaching shaft 25 on the apparatus main body 2 side. In conjunction with this, the opening and closing unit side end portion 52 of the joint support portion 5 (and the second joint support portion 50) in the support member 4 gradually moves apart from the main body side end portion 51, so that the central portion, etc., of the joint support portion 5 (and the second joint support portion 50) moves downward, and the curved and deformed state starts to be eliminated.

At this time, the main body side end portion 51 of the joint support portion 5 in the support member 4 rotates around the attaching shaft 25 as a pivot (counterclockwise in FIG. 12). Then, when the opening and closing unit 3 is opened by a predetermined angle θ1, the projection portion 6 in the support member 4 comes into contact with the wall surface 22*a* of the support frame of the apparatus main body 2.

After the projection portion 6 of the support member 4 comes into contact with the support frame wall surface 22*a* of the apparatus main body 2, when the opening and closing unit 3 further moves in the arrow A direction and shifts into the opened state, as shown in FIG. 3 and FIG. 13, the opening and closing unit side end portion 52 of the joint support portion 5 (and the second joint support portion 50) in the support member 4 further moves diagonally downward apart from the main body side end portion 51, and finally, the curved and deformed state of the joint support portion 5 (and the second joint support portion 50) is completely eliminated and the joint support portion extends straight.

At this time, in the process of extending straight of the joint support portion 5 (and the second joint support portion 50), as shown in FIG. 13, a force F generated when the opening and closing unit 3 moves to open is transmitted to the joint support portion 5, etc., as an external force for extending the joint support portion 5, etc., straight, and on the other hand, the projection portion 6 is present while pressed against the support frame wall surface 22*a* and restrains the joint support portion 5, etc., extending straight. In other words, the joint support portion 5, etc., try to rotate counterclockwise in FIG. 13 around the attaching shaft 25 as a pivot at the main body side end portion 51, however, this rotation is restrained by the projection portion 6 pressed against the support frame wall surface 22*a*.

However, at this time, the projection portion 6 is elastically deformed so as to tilt in the direction C of approaching the joint support portion 5, etc. (elastically deformed so as to shift into the state shown by the solid line from the state of the projection portion 6 shown by the alternate long and short double-dashed line in FIG. 13). Accordingly, the joint support portion 5, etc., rotates counterclockwise at the end portion 51 against the resisting force J (force applied opposite to the force F generated when the opening and closing unit 3 moves to open) due to the elastic deformation of the projection portion 6, and finally extends straight. When the joint support portion 5, etc., extend straight, the opening angle θ of the opening and closing unit 3 reaches the maximum opening angle θ2.

Therefore, until the joint support portion 5, etc., extend straight (the opening and closing unit 3 reaches the maximum opening angle θ2) from the state where the projection portion 6 of the support member 4 is pressed against the wall surface 22*a* of the support frame (the opening and closing unit 3 reaches the opening angle θ1), in this opening process, the opening and closing unit 3 opens while subjected to the resisting force J of the support member 4 as an impact absorbing force. The resisting force J corresponds to a force required for elastically deforming the projection portion 6 from the state shown by the alternate long and short double-dashed line to the state shown by the solid line in FIG. 13.

In this support member 4, the presence of the connecting portion 7 which connects the projection portion 6 and the joint support portion 5 makes it difficult to elastically deform the projection portion 6 in the direction C of approaching the joint support portion 5, etc., and increases the resisting force J of the support member 4. Due to the presence of the connecting portion 7, the force of the projection portion 6 to elastically deform when the opening and closing unit 3 is opened is transmitted to the joint support portion 5 side via the connecting portion 7 and the joint support portion 5 is bent at the connecting position 59 as a center (FIG. 13), and the force required for this bending is also utilized as the resisting fore J of the support member 4. At this time, due to the presences of the gap portions 56 and 54 formed in the shaft insertion holes 53 and 54 of both end portions 51 and 52 of the joint support portion 5, the end portions 51 and 52 are easily rotated and deformed around the respective attaching shafts 25 and 38 as pivots, and as a result, the joint support portion 5 easily bends, and even when the joint support portion 5 is bent and deformed, this does not apply extra loads to the end portions 51 and 52 of the attaching shafts 25 and 38.

On the other hand, to close the opening and closing unit 3 in an opened state, the opening and closing unit 3 is moved in the arrow B direction.

At this time, the attaching shaft 38 on the opening and closing unit 3 side moves so as to gradually approach the attaching shaft 25 on the apparatus main body 2 side from the diagonally lower position. In conjunction with this, the opening and closing unit side end portion 52 of the joint support portion 5 (and the second joint support portion 50) in the support member 4 gradually approaches the main body side end portion 51, so that the central portion, etc., of the joint support portion 5 (and the second joint support portion 50) moves upward (P1) and starts curving and deforming (see FIG. 2 and FIG. 12, etc.). In addition, the elastically deformed state of the projection portion 6 in the support member 4 also starts to be restored and eliminated by moving gradually in the arrow D direction. Finally, in the support member 4, the joint support portion 5, etc., are curved and deformed as described above, and the projection portion 6 comes apart from the support frame wall surface 22*a* of the apparatus main body 2 (see FIG. 1 and FIG. 11, etc.).

In this embodiment, as shown in FIG. 4, a second support member 8 is fitted between a side surface portion on one side of the opening and closing unit 3 (side portion on the front face side of the apparatus main body 2 in this example) and the apparatus main body 2.

Figure 14:
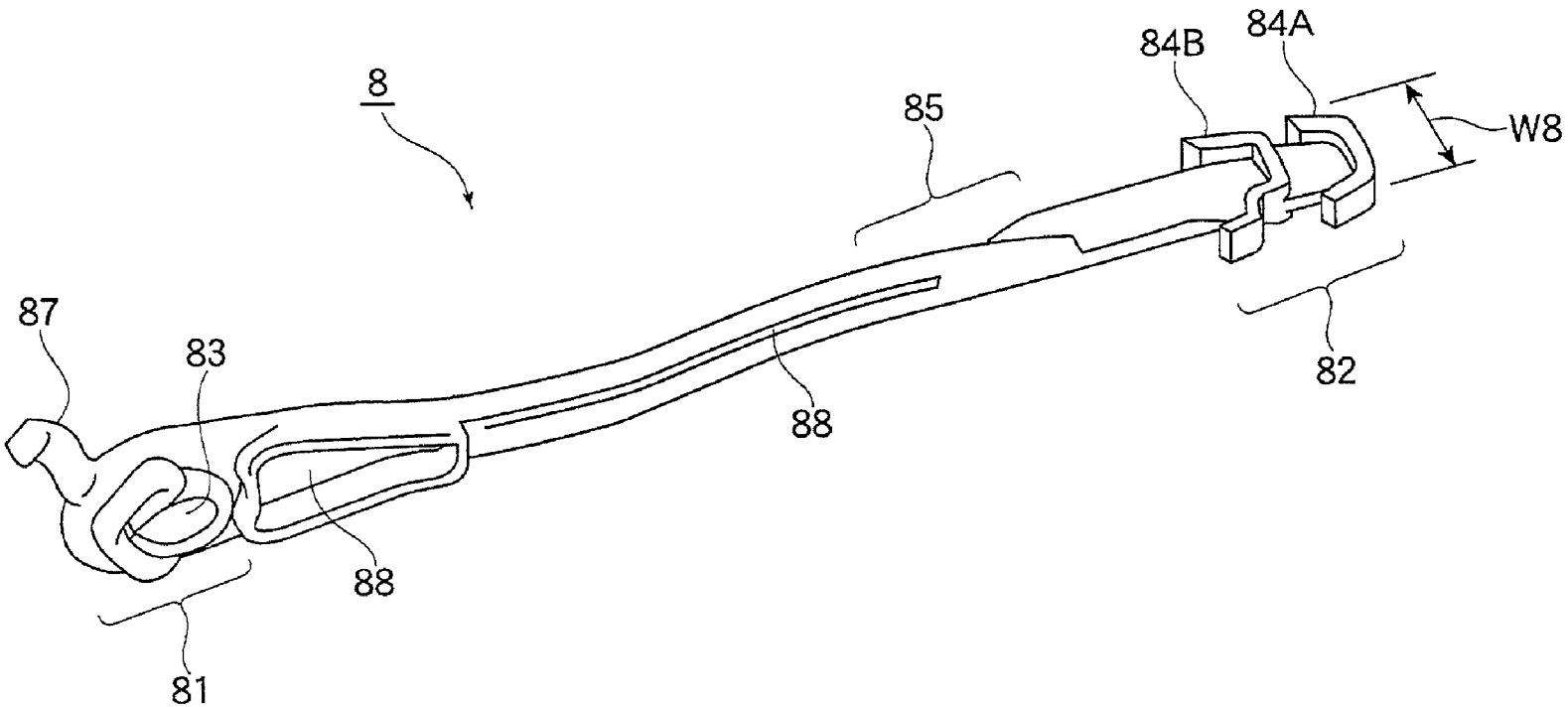
FIG. 14 is a perspective view showing a second support member.
Figure 15:
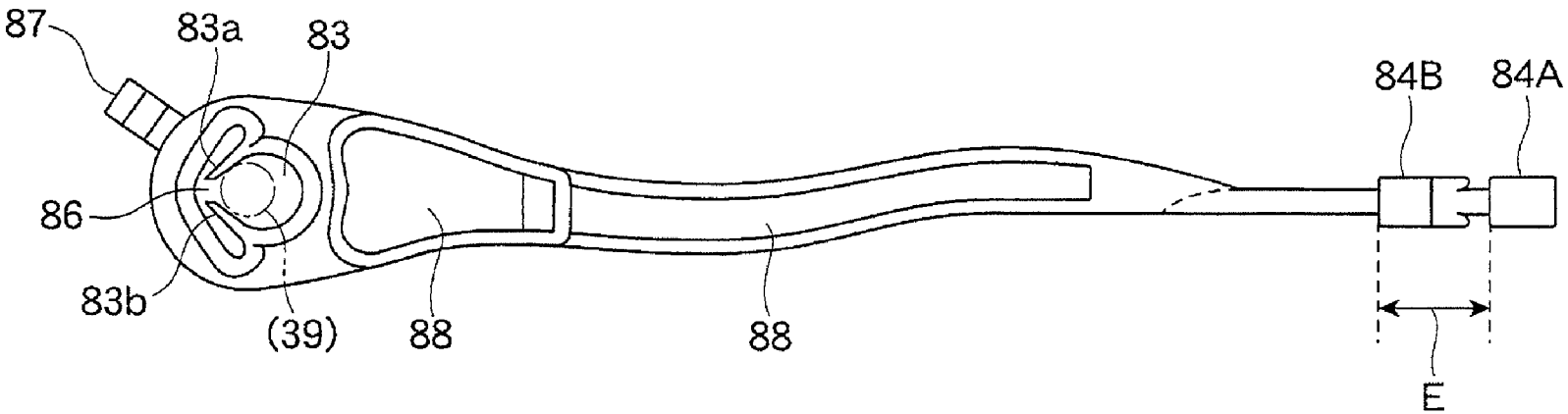
FIG. 15 is a front view showing the second support member of FIG. 14.

The second support member 8 has a narrow and long plate shape as a whole as shown in FIG. 14 and FIG. 15, etc., and one end portion 81 thereof is attached to the opening and closing unit 3 side rotatably, and the other end portion 82 is attached to and hooked on the apparatus main body 2 side. In the one end portion 81, a shaft insertion hole 83 to be inserted onto the attaching shaft 39 of the opening and closing unit 3 is formed. On the other end portion 82, two hook projection portions 84A and 84B projected to both left and right sides so that they are inserted in an attaching hole 28 formed in the support frame 22 of the apparatus main body 2 are formed while leaving a predetermined space E between the hook end portions thereof. The side widths W8 of the hook projection portions 84A and 84B are both set to be larger than the side width L1 of the attaching hole 28 (W8>L1). The side width L2 of the attaching hole 28 is set to be larger than the side width W8 of the hook projection portions 84A and 84B (L2>W8).

In this embodiment, the second support member 8 is formed in a state where a connecting portion (twisted portion 85) between a portion on the side with one end portion 81 positioned and a portion on the side with the other end portion 82 positioned is twisted by about 90 degrees so that the portion on the side with one end portion 81 positioned is like an upright (vertical) plate, while the portion on the side with the other end portion 82 positioned is like a plate laid down (horizontal). On the end portion 81 in which the shaft insertion hole 83 is formed, a gap portion 86 spaced so as to notch a portion of the end portion on the side opposite to the other end portion 82 is formed. In other words, on the second support member 8 in which the opening and closing unit side shaft insertion hole 83 is formed, a gap portion 86 having a shape which notches a portion of the end surface of the hollow cylindrical shape with an inner diameter corresponding to the opening and closing unit side shaft insertion hole 83 is formed, and accordingly, the shaft insertion hole end portions 83*a* and 83*b* facing each other across the gap portion 86 on the end surface of the hollow cylindrical shape are formed into plate shapes elastically deformable. The reference numeral 87 in FIG. 14 and FIG. 15, etc., denotes a claw which is inserted and hooked in an attaching opening hole formed in the opening and closing unit 3 in order to prevent the second support member 8 from coming off from the support shaft not shown. The reference numeral 88 denotes a gap portion.

Figure 16:
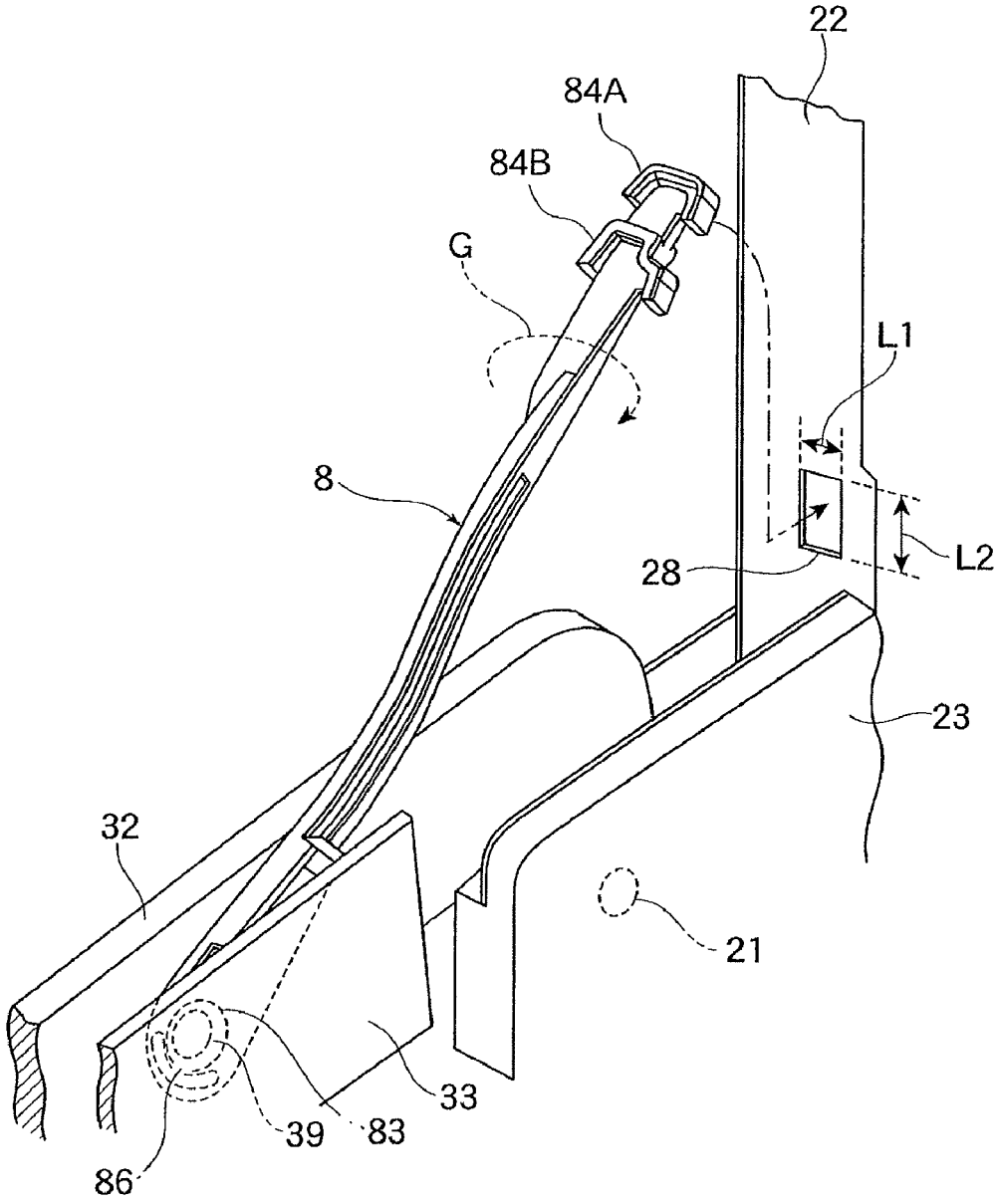
FIG. 16 is an explanatory view showing an attached state of the second support member of FIG. 14.

This second support member 8 is attached so that, as shown in FIG. 16, while the one end portion 81 is inserted into the attaching shaft 39 of the opening and closing unit 3 through the shaft insertion hole 83, the other end portion 82 twisted by about 90 degrees is inserted into the attaching hole 28 of the support frame 22 of the apparatus main body 2 and then released, and either one of the hook projection portions 84A and 84B is hooked in the attaching hole 28. This second support member 8 can adjust the opening and closing angle θ of the opening and closing unit 3 by changing (replacing) the hook projection portions 84A and 84B to be hooked in the attaching hole 28. In this example, by attaching the hook projection portion 84B, the opening and closing angle is set so as to match the maximum opening and closing angle θ2 (FIG. 13) of the opening and closing unit 3 according to the support member 4. When the opening and closing unit 3 is closed or completely closed, the second support member 8 is held in the state where the end portions with the shaft insertion hole 83 formed is attached to the attaching shaft 39 (FIG. 15, FIG. 16) of the opening and closing unit 3, and on the other hand, the end portion on the side with the hook projection portion 84 formed is pushed into the inside of the support frame 22 (through the attaching hole 28).

(Exemplary Variation)

Figure 17:
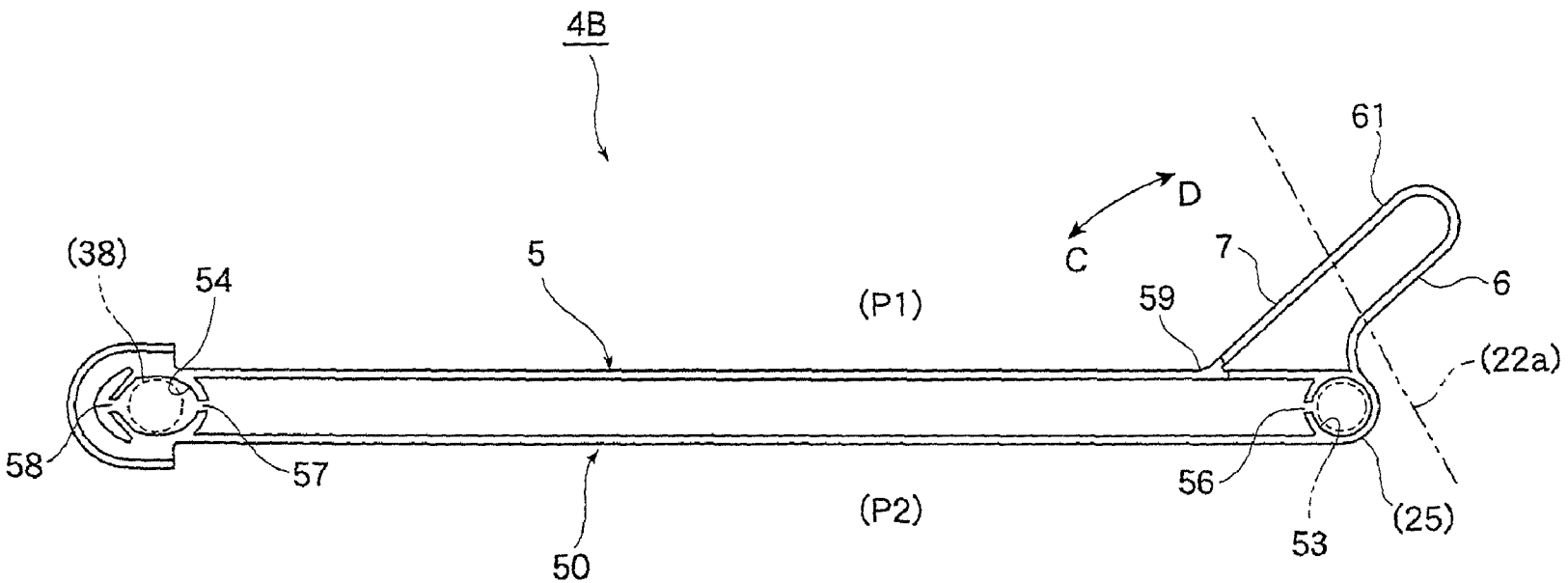
FIG. 17 is a front view of the support member showing another fitting example of the support member.

In the above-described embodiment, as shown in FIG. 17, the opening and closing support mechanism 1 may be constructed so that the support member 4 in the opening and closing support mechanism 1 is used in a state upside down (the support member to be used in this state is referred to as a support member 4B), and the support member 4B in this state is fitted to the apparatus main body 2 and the opening and closing unit 3.

Figure 18:
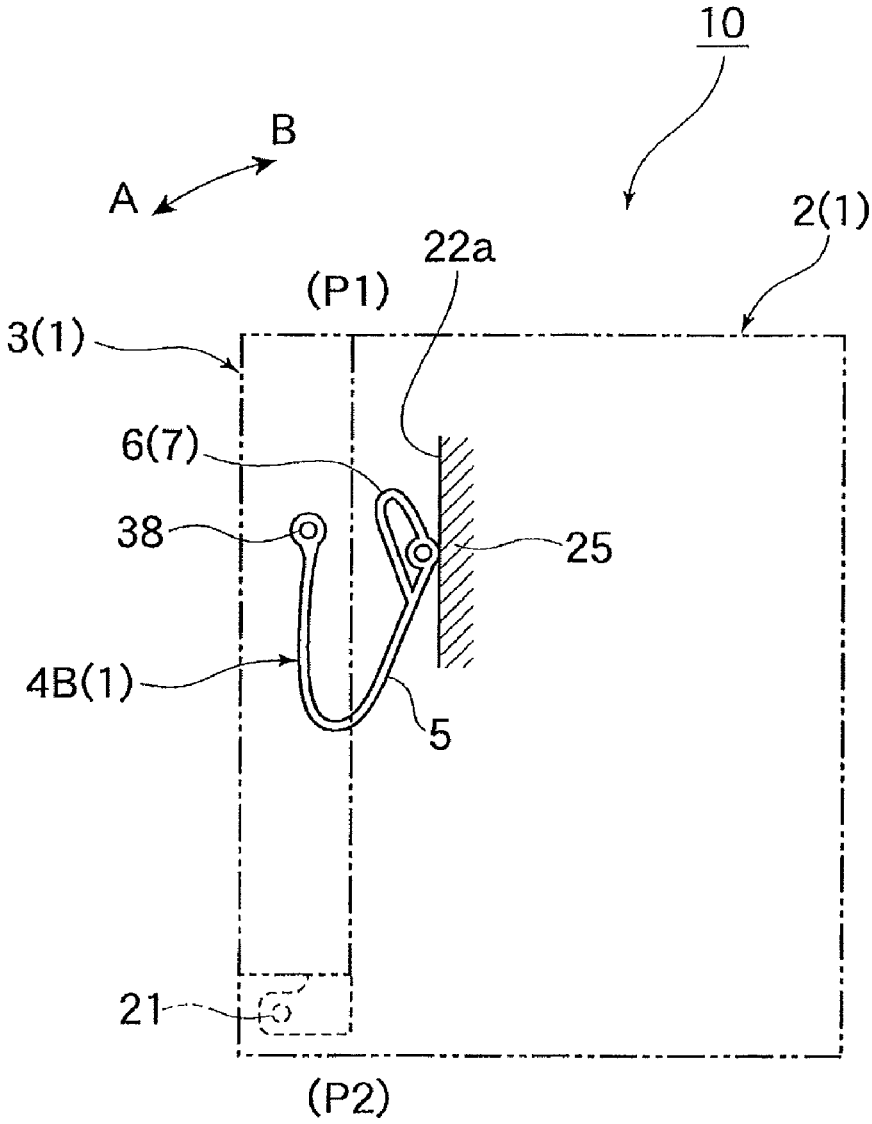
FIG. 18 is an explanatory view showing a main portion (in a state when the opening and closing unit is closed) of the opening and closing support mechanism and the image forming apparatus using the opening and closing support mechanism when the support member of FIG. 17 is fitted.

In this case, as shown in FIG. 18, etc., one end portion of the joint support portion 5 in the support member 4B is inserted onto the attaching shaft 25 via the shaft attaching hole 53 and attached to the apparatus main body side 2, and the other end portion 52 is inserted onto and attached to the attaching shaft 38 via the shaft attaching hole 54. At this time, the projection portion 6 and the connecting portion 7 in the support member 4B are positioned at the upper side of the attaching shaft 25.

In the image forming apparatus 10 to which the support member 4B is fitted, when the opening and closing unit 3 is closed, as shown in FIG. 18, the joint support portion 5 in the support member 4B is curved and deformed downward (P2). At this time, the projection portion 6 in the support member 4B is apart from the support frame wall surface 22*a* of the apparatus main body 2.

Figure 19:
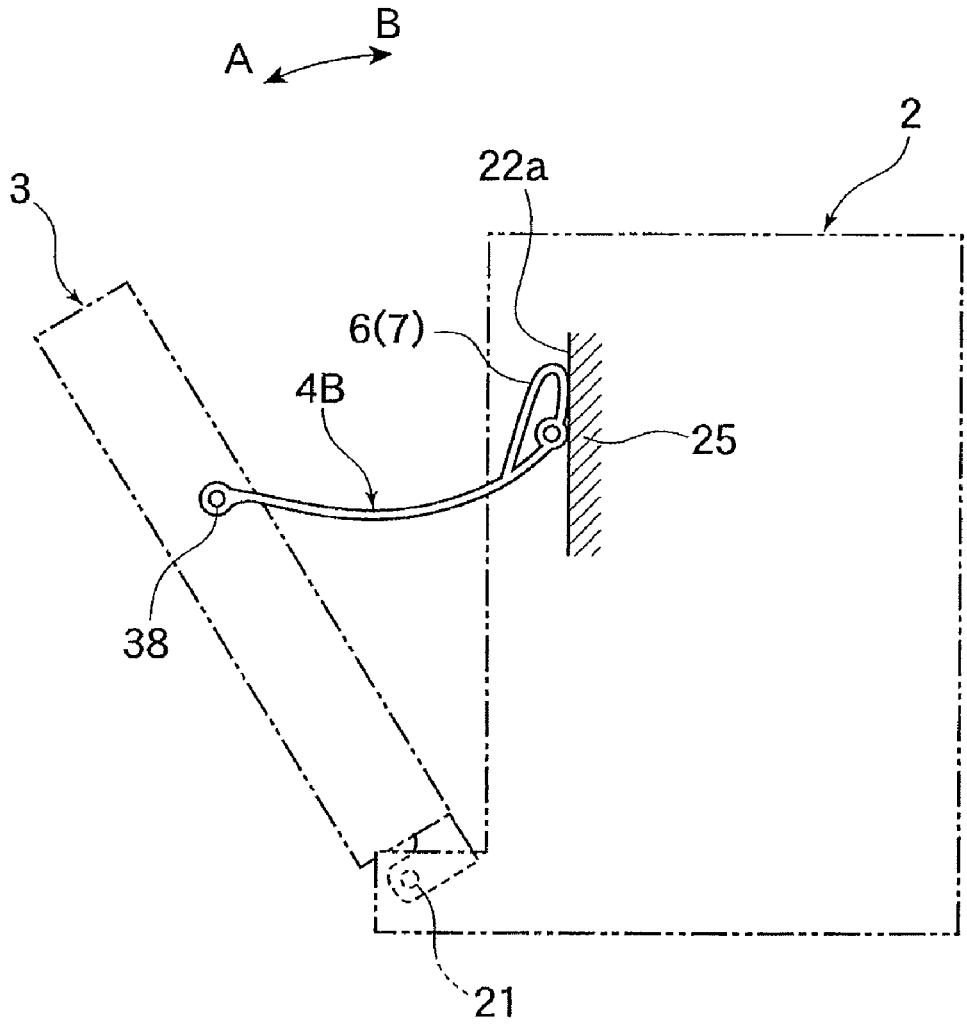
FIG. 19 is an explanatory view showing a state in the middle of starting opening (or closing) the opening and closing unit in FIG. 18.
Figure 20:
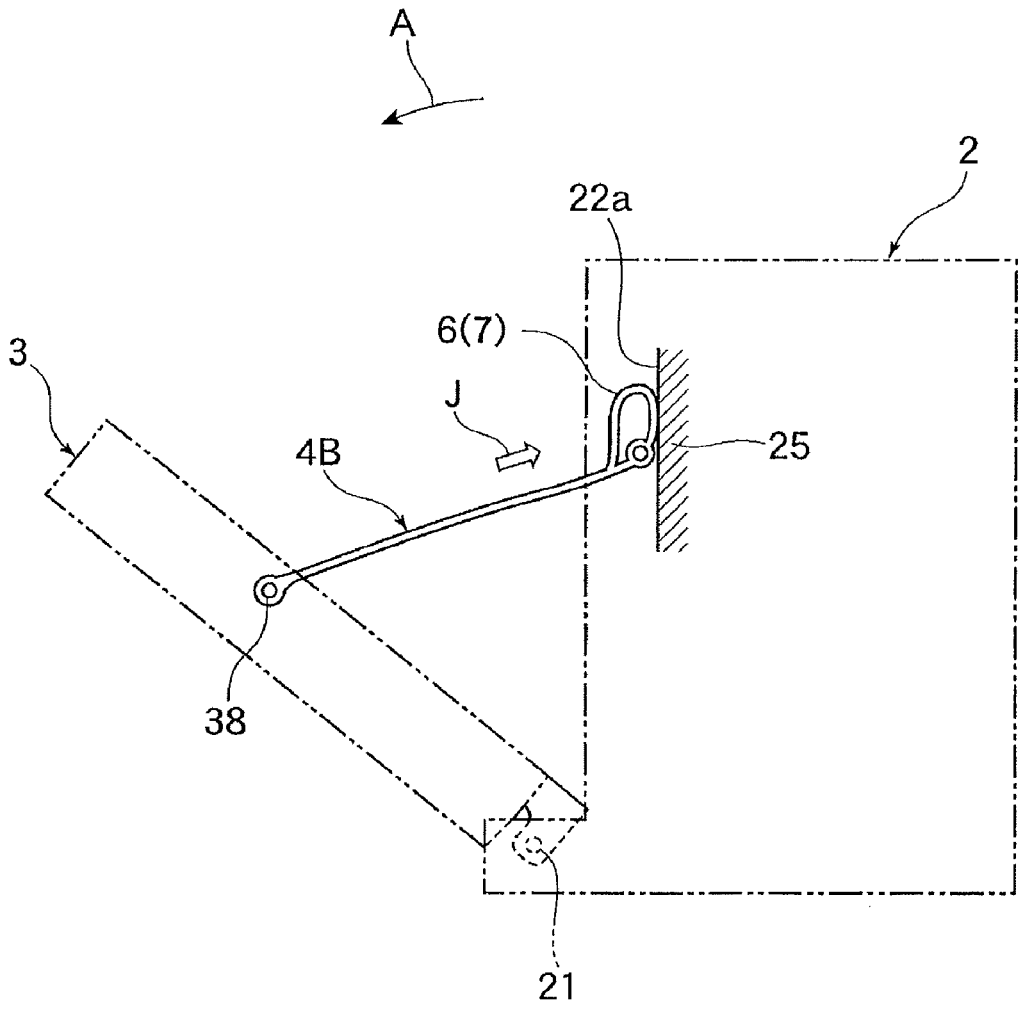
FIG. 20 is an explanatory view showing a state where the opening and closing unit is completely opened in FIG. 18.

On the other hand, when the opening and closing unit 3 is moved and opened in the arrow A direction, as shown in FIG. 19, the joint support portion 5 in the support member 4B moves upward (P1) and the curved and deformed state starts to be eliminated, and in the middle of this movement, the projection portion 6 comes into contact with the support frame wall surface 22*a* of the apparatus main body 2. Then, when the opening and closing unit 3 is completely opened, as shown in FIG. 20, the joint support portion 5 in the support member 4B extends straight between the attaching shaft 25 and the attaching shaft 38, and on the other hand, the projection portion 6 and the connecting portion 7 are elastically deformed in a direction of approaching the joint support portion 5 and generate a resisting force J in a direction of restraining the joint support portion 5 extending straight.

Figure 21:
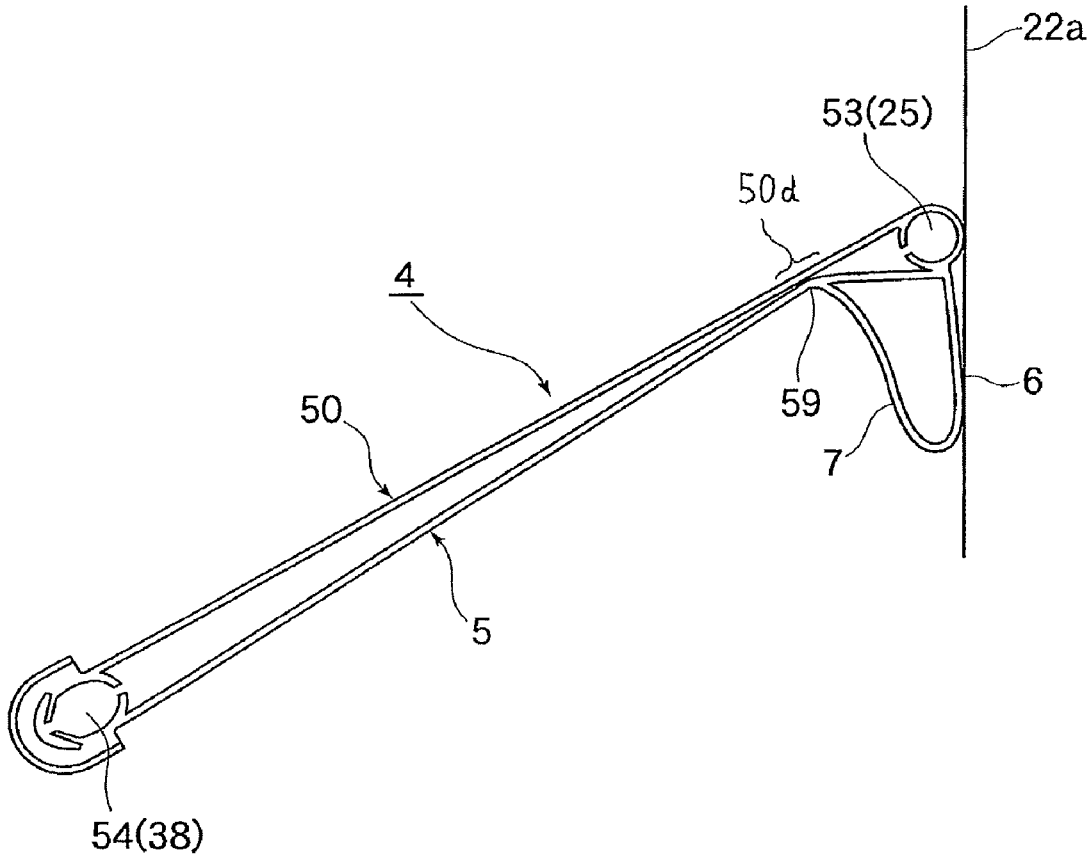
FIG. 21 is a state view of the support member showing another construction example of the support member.
Figure 22:
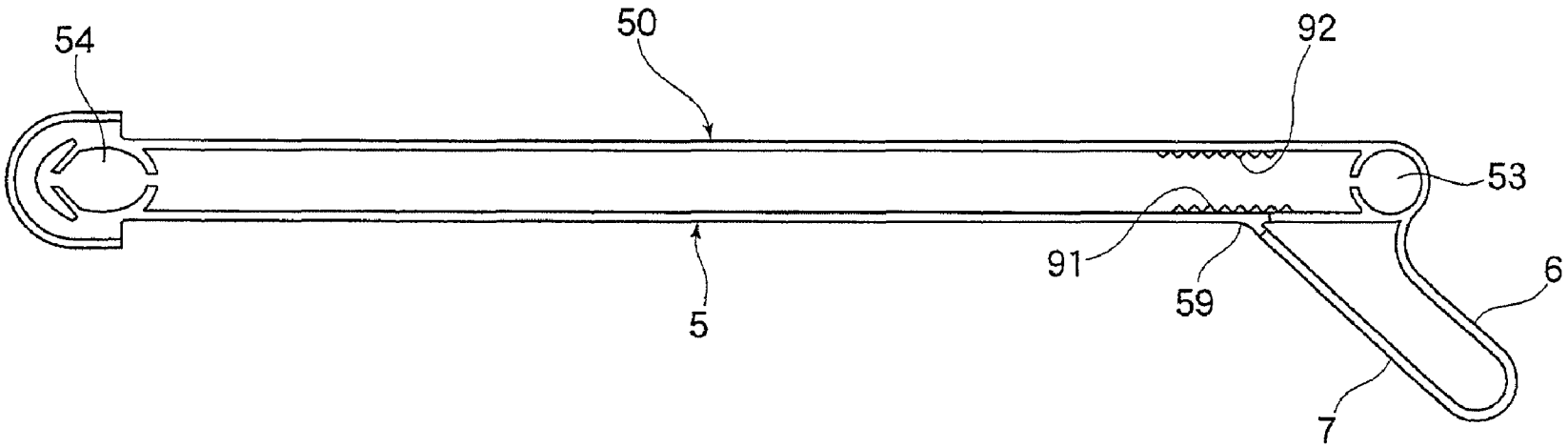
FIG. 22 is an explanatory front view showing another construction example when the support member of FIG. 21 is used.

In the above-described embodiment, as shown in FIG. 21, when adopting a construction in which, in the middle of opening the opening and closing unit 3, the connecting position 59 of the joint support portion 5 to the connecting portion 7 in the support member 4 comes into contact with a portion 50*d* of (the inside surface of) the second joint support portion 50, as shown in FIG. 22, (the inside surface of) the portion 50*d* of the joint support portion 5 which comes into contact with the second support 50 is formed as an uneven surface 91 which increases the frictional resistance.

In this case, when the opening and closing unit 3 is opened, when the projection portion 6 is elastically deformed and the connecting position 59 of the joint support portion 5 come into contact with the portion 50*d* of the second joint support portion 50, the frictional resistance increases, and the generation of the frictional resistance makes it difficult to elastically deform the projection portion 6 in the direction of approaching the joint support portion 5, and accordingly, it becomes difficult to extend the joint support portion 5 straight. Accordingly, the impact absorbing force of the support member 4 is increased. In this case, the inside surface portion of the second joint support portion 50 with which the connecting position 59 of the joint support portion 5 comes into contact is also formed as an uneven surface 92 (FIG. 22).

Figure 23:
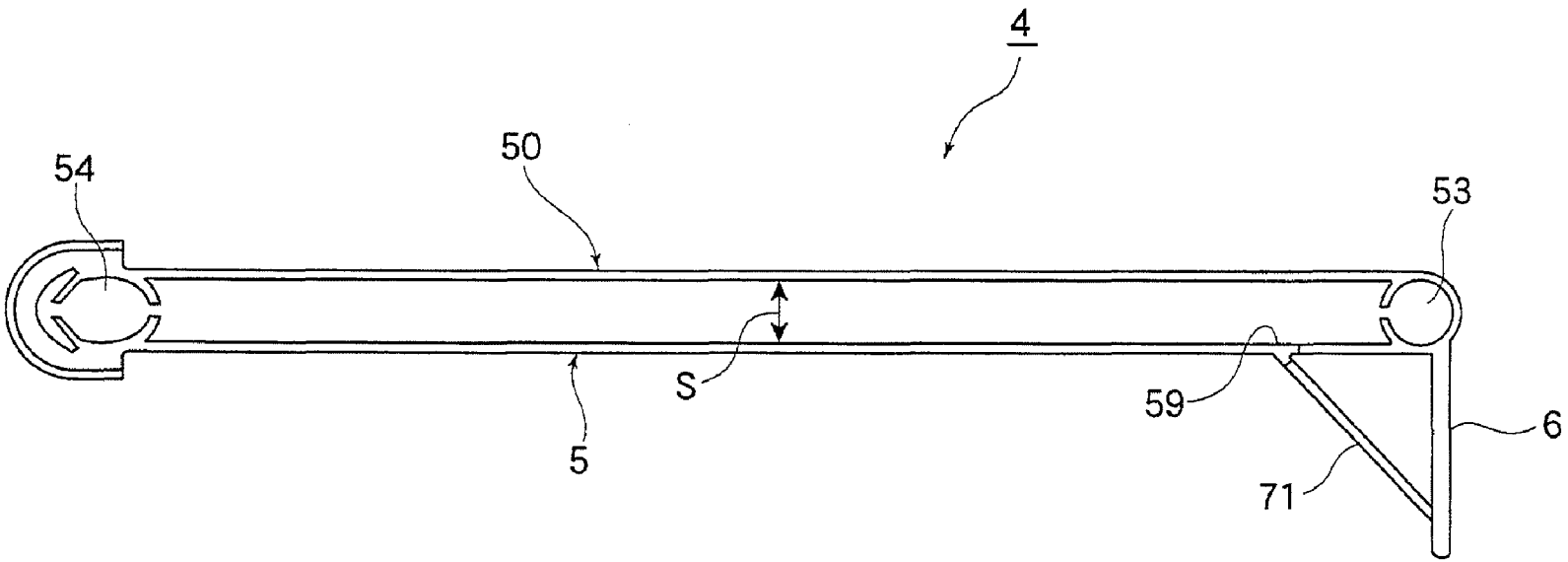
FIG. 23 is a front view showing another construction example of the support member.

Further, in the above-described embodiment, as the support member 4, as shown in FIG. 23, a support member (71) which has a projection portion 6 formed to project in a tabular shape (tabular projection portion 61) and has a connecting portion 7 connecting the tip end portion or a portion slightly inward of the tip end portion of the tabular projection portion 61 and a portion of the joint support portion 5 can be used. It is allowed that the connecting portion 7 is in a disconnecting state where it does not connect the tip end portion and a portion of the joint support portion.

Figure 24:
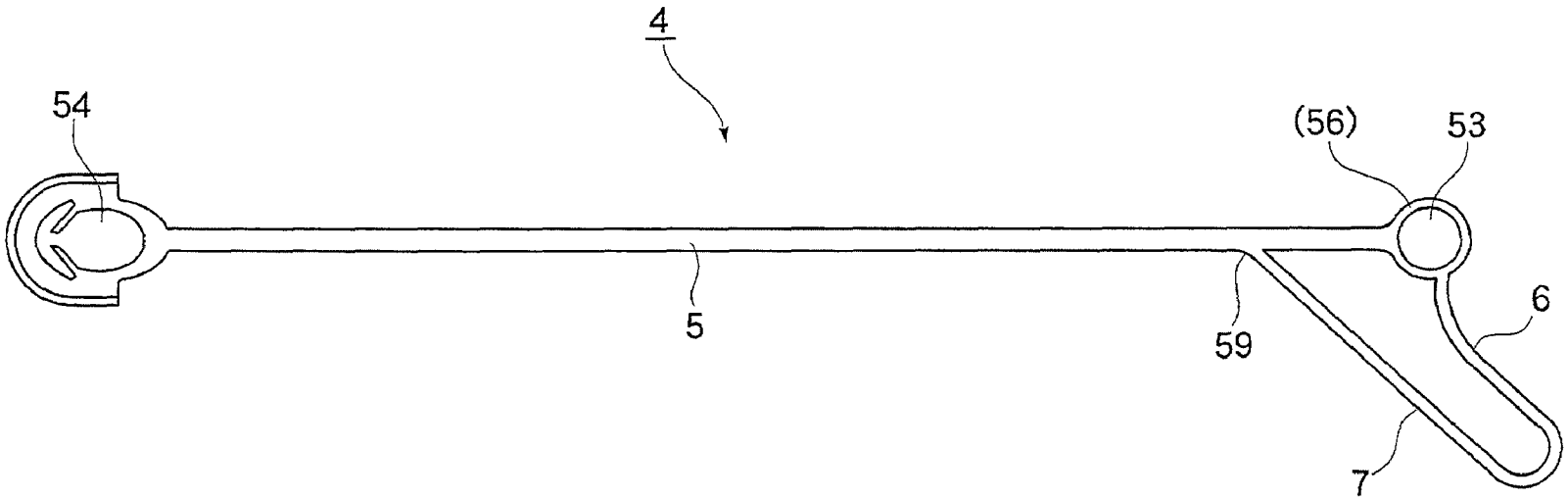
FIG. 24 is a front view showing another construction example of the support member.

In addition, in the above-described embodiment, as the support member 4, as shown in FIG. 24, a support member which has one joint connecting portion 9 without forming the second joint support portion 50 can be used. In this case, a gap portion 56 in a noncontact state may be formed on the joint insertion hole 53 of the end portion 51 on the side at which the projection portion 6 is formed (on the side opposite to the side at which the projection portion 6 is formed).

Figure 25:
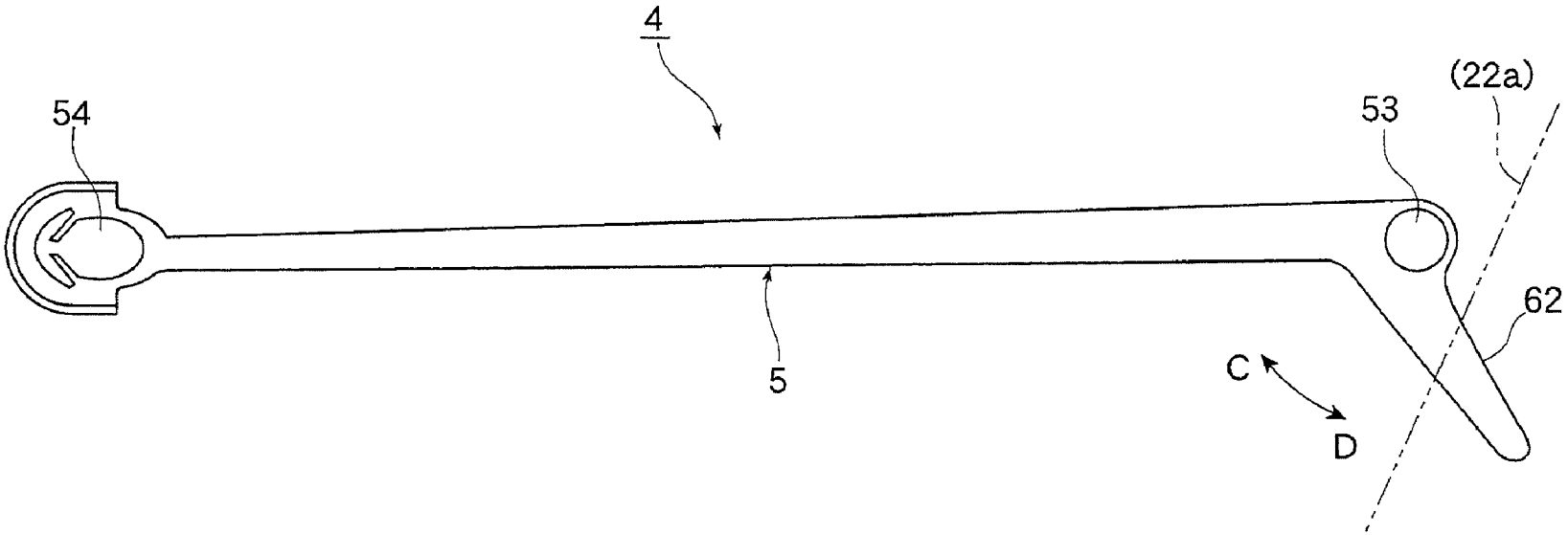
FIG. 25 is a front view showing another construction example of the support member.

In the above-described embodiment, as the support member 4, as shown in FIG. 25, a support member in which the connecting portion 7 is not formed but a projection portion 6 is formed (projection portion 62) can be used. In this case, by adjusting the thickness and elastic characteristics of the projection portion 62, the impact absorbing amount of the support member 4 can be adjusted.

In the above-described embodiment, the opening and closing support mechanism 1 may be constructed by attaching the end portion 51 on the side at which the projection portion 6 of the support member 4 is formed to the opening and closing unit 3 side, and attaching the opposite end portion 52 to the apparatus main body 2 side. It is allowed that a plurality of support members 4 are fitted between the apparatus main body 2 and the opening and closing unit 3.

Further, in the above-described embodiment, an example in which the opening and closing support mechanism 1 is applied to the image forming apparatus 10 is described, however, the present invention can also be applied in the same manner to other apparatuses to which the opening and closing support mechanism 1 is applicable. Other apparatuses are, for example, a post-processing apparatus which performs post-processing such as truing up and filing of sheets on which images were formed, and an apparatus having an opening and closing member.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An opening and closing support mechanism comprising:

a main body;

a cover member that opens and closes around a support shaft as a pivot with respect to the main body; and an elastically deformable support member formed as one piece includes:

a joint portion that has one end portion attached to the main body rotatably and the other end portion attached to the cover member rotatably, the joint portion bending when the cover member is closed, and straightening when the cover member is opened; and a projection portion that projects to an opposite side of a bending side of the joint portion and is disposed at either one end portion or the other end portion of the joint portion when the cover member is closed, and is elastically deformed in a direction of approaching the joint portion while pressed against a portion of the main body or the cover member when the cover member is opened.

2. The opening and closing support mechanism as claimed in claim 1, further comprising:

a connecting portion that is provided at an opposite side of a pressed side of the projection portion against the main body or cover member, and is connected to a portion of the joint portion.

3. The opening and closing support mechanism as claimed in claim 2, wherein the projection portion and the connecting portion are formed as one curved annular shape.

4. The opening and closing support mechanism as claimed in claim 2, wherein the joint portion has a first width of a first area covering from an end portion opposite to an end portion at which the projection portion is formed to the position to which the connecting portion is connected, and a second width of a second area other than the first area, and the first width is narrower than the second width.

5. The opening and closing support mechanism as claimed in claim 1, wherein the joint portion has a shaft insertion hole at an end portion at which the projection portion is formed, and a gap portion that is spaced so as to notch by a predetermined amount a portion of the shaft insertion hole facing an end portion opposite to the end portion at which the projection portion is formed.

6. The opening and closing support mechanism as claimed in claim 1, wherein the joint portion has a shaft insertion hole at the end portion opposite to the end portion at which the projection portion is formed, an a gap portion that is spaced so as to notch a portion of the shaft insertion hole by a predetermined amount, and the joint portion includes plate portions having a plate shape, and facing each other across the gap portion on an end surface of a hollow cylindrical shape with an inner diameter corresponding to the shaft insertion hole.

7. An image forming apparatus comprising:

an apparatus main body;

a cover member that opens and closes around a support shaft as a pivot with respect to the apparatus main body; and an opening and closing support mechanism according to of claim 1.

8. The image forming apparatus as claimed in claim 7, wherein the apparatus main body is a main body of an image forming apparatus.

9. The opening and closing support mechanism according to claim 1, wherein the joint portion being a single deformable member.

10. The opening and closing support mechanism according to claim 1, wherein the projection portion is connected to the joint portion.

* * * * *